US009885994B2

(12) United States Patent
Asakawa

(10) Patent No.: US 9,885,994 B2
(45) Date of Patent: Feb. 6, 2018

(54) SHEET CONVEYANCE APPARATUS, IMAGE FORMING APPARATUS, AND IMAGE FORMING SYSTEM

(71) Applicant: KONICA MINOLTA, INC., Chiyoda-ku, Tokyo (JP)

(72) Inventor: Minoru Asakawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/188,778

(22) Filed: Jun. 21, 2016

(65) Prior Publication Data

US 2017/0023901 A1 Jan. 26, 2017

(30) Foreign Application Priority Data

Jul. 21, 2015 (JP) ..... 2015-143576

(51) Int. Cl.
*G03G 15/00* (2006.01)
*G03G 21/00* (2006.01)
(Continued)

(52) U.S. Cl.
CPC ..... *G03G 15/70* (2013.01); *B65H 1/00* (2013.01); *B65H 39/10* (2013.01);
(Continued)

(58) Field of Classification Search
CPC .... G03G 15/00; G03G 15/70; G03G 15/6514; G03G 15/6538; G03G 15/655;
(Continued)

(56) References Cited

U.S. PATENT DOCUMENTS 7,724,389 B2 * 5/2010 Matsubara ..... B41J 13/0009 358/1.16
2002/0126309 A1 * 9/2002 Shimada ..... G03G 15/655 358/1.14

(Continued)

FOREIGN PATENT DOCUMENTS

JP 2003280305 A 10/2003
JP 2010049171 A 3/2010
JP 2015049491 A * 3/2015 ..... G03G 15/00

OTHER PUBLICATIONS

Japanese Office Action dated Aug. 22, 2017 issued in counterpart Japanese Application No. 2015-143576.

*Primary Examiner* — Nguyen Ha
(74) *Attorney, Agent, or Firm* — Holtz, Holtz & Volek PC

(57) ABSTRACT

A sheet conveyance apparatus which conveys sheets fed from a first sheet feeding unit and sheets fed from a second sheet feeding unit to a merging point, inserts the sheets fed from the first sheet feeding unit into the sheets fed from the second sheet feeding unit in a predetermined order at the merging point, and discharges the sheets fed from the first sheet feeding unit and the sheets fed from the second sheet feeding unit to a downstream side includes: a jam detecting unit configured to detect a jam of a sheet in the first sheet feeding unit; and a control unit configured to newly feed sheets which are before the predetermined order, in which a sheet causing the jam is supposed to be inserted, and have not been fed from the second sheet feeding unit, and convey the newly fed sheets to the downstream side.

12 Claims, 16 Drawing Sheets

(51) Int. Cl.

| | |
|---|---|
| ***G03G 21/14*** | (2006.01) |
| ***B65H 33/04*** | (2006.01) |
| ***B65H 1/00*** | (2006.01) |
| ***B65H 39/10*** | (2006.01) |
| *B65H 3/44* | (2006.01) |
| *B65H 3/52* | (2006.01) |
| *B65H 7/06* | (2006.01) |
| *B65H 7/20* | (2006.01) |

(52) U.S. Cl.
CPC ..... *G03G 15/5012* (2013.01); *G03G 15/6538* (2013.01); *B65H 3/44* (2013.01); *B65H 3/5261* (2013.01); *B65H 7/06* (2013.01); *B65H 7/20* (2013.01); *B65H 2301/4318* (2013.01); *B65H 2405/332* (2013.01); *B65H 2511/414* (2013.01); *B65H 2511/51* (2013.01); *B65H 2511/528* (2013.01); *B65H 2513/42* (2013.01); *G03G 15/655* (2013.01); *G03G 15/6514* (2013.01); *G03G 2215/00552* (2013.01)

(58) Field of Classification Search
CPC ..... G03G 21/00; G03G 21/14; B65H 1/00; B65H 33/04
USPC ..... 399/407
See application file for complete search history.

(56) References Cited

U.S. PATENT DOCUMENTS

| | | | | |
|---|---|---|---|---|
| 2006/0145414 | A1* | 7/2006 | Yokobori ..... | G03G 15/5012 271/258.01 |
| 2007/0147855 | A1* | 6/2007 | Shimada ..... | G03G 15/655 399/21 |
| 2014/0015189 | A1* | 1/2014 | Minamisawa ..... | B65H 29/00 271/3.18 |
| 2014/0168701 | A1* | 6/2014 | Kato ..... | G03G 15/6538 358/1.15 |
| 2014/0241737 | A1* | 8/2014 | Shirasaka ..... | G03G 15/6552 399/20 |
| 2015/0049356 | A1* | 2/2015 | Saitsu ..... | B65H 7/06 358/1.14 |

* cited by examiner

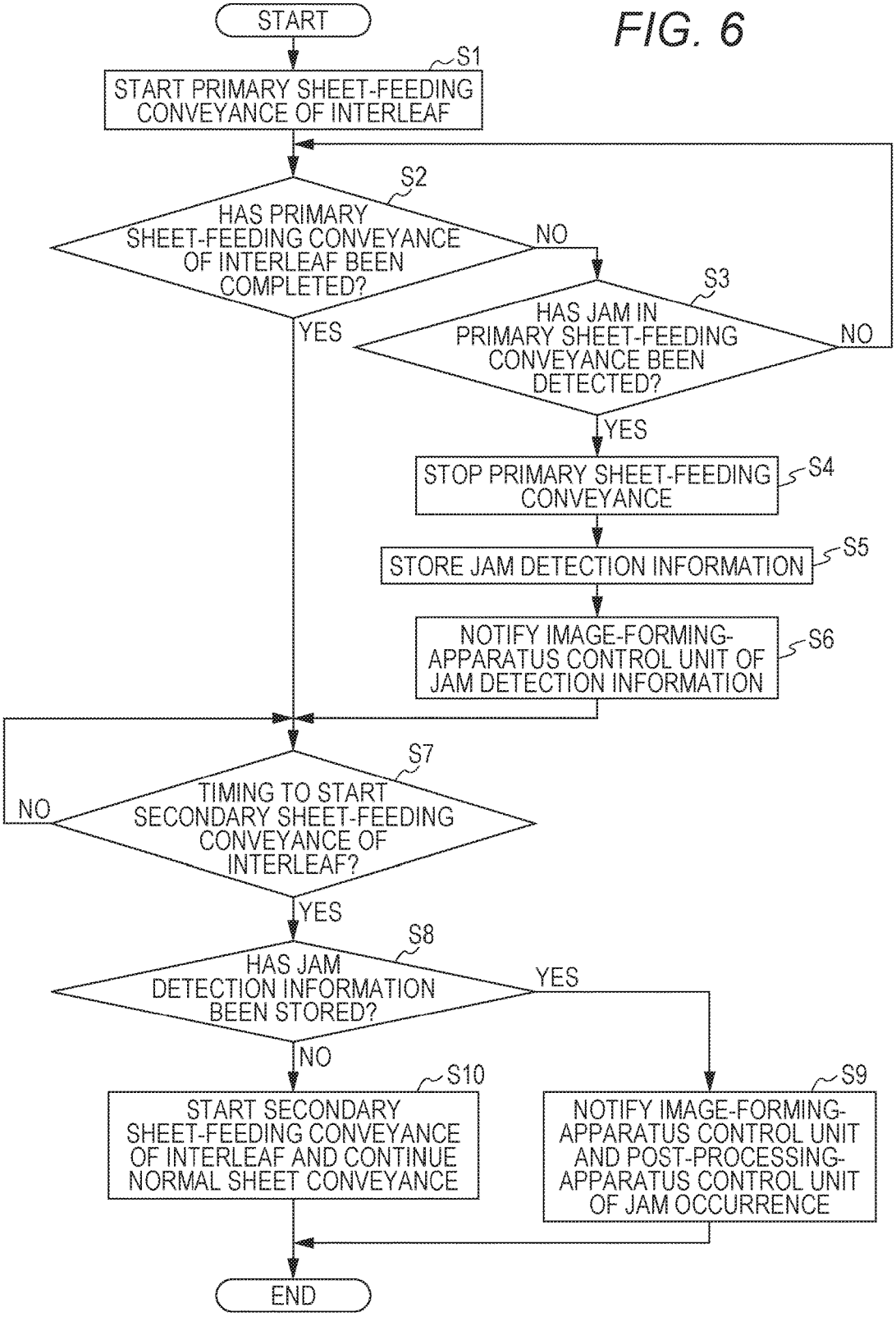
FIG. 6
START
S1
START PRIMARY SHEET-FEEDING CONVEYANCE OF INTERLEAF
S2
HAS PRIMARY SHEET-FEEDING CONVEYANCE OF INTERLEAF BEEN COMPLETED?
NO
YES
S3
HAS JAM IN PRIMARY SHEET-FEEDING CONVEYANCE BEEN DETECTED?
NO
YES
STOP PRIMARY SHEET-FEEDING CONVEYANCE
S4
STORE JAM DETECTION INFORMATION
S5
NOTIFY IMAGE-FORMING-APPARATUS CONTROL UNIT OF JAM DETECTION INFORMATION
S6
S7
TIMING TO START SECONDARY SHEET-FEEDING CONVEYANCE OF INTERLEAF?
NO
YES
S8
HAS JAM DETECTION INFORMATION BEEN STORED?
YES
NO
S10
START SECONDARY SHEET-FEEDING CONVEYANCE OF INTERLEAF AND CONTINUE NORMAL SHEET CONVEYANCE
S9
NOTIFY IMAGE-FORMING-APPARATUS CONTROL UNIT AND POST-PROCESSING-APPARATUS CONTROL UNIT OF JAM OCCURRENCE
END

SHEET CONVEYANCE APPARATUS, IMAGE FORMING APPARATUS, AND IMAGE FORMING SYSTEM

The entire disclosure of Japanese Patent Application No. 2015-143576 filed on Jul. 21, 2015 including description, claims, drawings, and abstract are incorporated herein by reference in its entirety.

BACKGROUND OF THE INVENTION

Field of the Invention

The present invention relates to a sheet conveyance apparatus, an image forming apparatus, and an image forming system.

Description of the Related Art

There has been used an interleaf inserting apparatus which inserts interleaves, such as thick paper or colored paper (including a front cover sheet and a back cover sheet) into sheets on which an image is formed by an image forming apparatus. Sheet-feeding in the interleaf inserting apparatus includes two steps of primary sheet-feeding conveyance in which interleaves loaded on a loading unit are picked up and conveyed to a resist part, and secondary sheet-feeding conveyance in which the interleaves are conveyed from the resist part to a merging point with image-formed sheets. In the primary sheet-feeding conveyance, the interleaves on the loading unit need to be separated one by one by a separating roller or the like, and the time required for the primary sheet-feeding conveyance greatly varies according to the loading amount of the interleaves, the abrasion degree of the separating roller, and the like. Thus, the primary sheet-feeding conveyance is temporally unstable. The timing to start the primary sheet-feeding conveyance has been gradually advanced in order to ensure the productivity during the interleaves are inserted, and the primary sheet-feeding conveyance is controlled to be started before the actual insertion timing at the point when the insertion of the next interleaf is determined. In other words, in order to merge the interleaves with the image-formed sheets in a stable state, it is desired to complete the primary sheet-feeding conveyance as soon as possible. For example, the primary sheet-feeding conveyance can be advanced crossing jobs by completing the primary sheet-feeding conveyance of the interleaf to be used in the next job although the preceding job has not been terminated.

Furthermore, normally, when interleaves are inserted to a discharging path of the image-formed sheets from another path and a jam occurs during feeding an interleaf, the operation of the image forming apparatus has been forcibly stopped. Thus, the remaining sheets in the image forming apparatus need to be removed, and the operability has been poor. Accordingly, in order to reduce the remaining sheets in the image forming apparatus, there has been proposed an image forming apparatus which discharges the fed sheets in the apparatus after performing image forming processing without immediately stopping the apparatus when a jam occurs during feeding an interleaf (see JP 2003-280305 A). In other words, by continuing the operation to the sheets remaining inside the apparatus when the jam occurs, the efficiency of the operation at the time of recovery (recovery from the jam) is improved.

However, as described above, when primary sheet-feeding conveyance in an interleaf inserting apparatus is advanced and a jam occurs in the primary sheet-feeding conveyance, sheets before the order, in which the interleaf causing the jam is supposed to be inserted, have not been fed. In other words, the sheet-feeding and the conveyance of the sheets to be discharged before the uninserted interleaf have been suspended. In this case, the recovery needs to be performed from the sheets before the interleaf causing the jam in the order, and which has caused a problem that the productivity and the work efficiency when jobs are successively performed is reduced.

FIG. 17 illustrates an example of conventional sheet conveying control. In FIG. 17, an interleaf to be inserted as a front cover sheet of the k-th job (job k) is indicated as "Pk-front". A sheet on which the m-th image of the k-th job is to be formed is indicated as "Qk-m". An interleaf conveying path is a path to convey interleaves to be inserted, an image-forming-sheet conveying path is a path to convey sheets on which an image is to be formed, and a merged conveying path is a sheet conveying path after a merging point which is the sheets on which an image is to be formed and the interleaves are merged. The abscissa indicates time.

Here, it is assumed that it is instructed to discharge four sheets to form an image (image forming sheets), which sheets are to be discharged after a front cover sheet (interleaf) is discharged in the job 1, and to discharge an image forming sheet which is a sheet to be discharged after a front cover sheet (interleaf) is discharged in the job 2. When the sheets until the third image forming sheet of the job 1 have been fed at the point when a jam is detected during primary sheet-feeding conveyance of the front cover sheet of the job 2, the fourth image forming sheet of the job 1 has not been fed but the sheet-feeding is stopped. As a result, at the point when the sheets until the third image forming sheet of the job 1 have been conveyed following the front cover sheet of the job 1, the job is suspended. In other words, although the jam is caused by a sheet (interleaf) of the job 2, the job 1 is suspended in the middle, and the recovery needs to be performed from the fourth image forming sheet of the job 1. Thus, the productivity and work efficiency at recovery have been poor.

SUMMARY OF THE INVENTION

The present invention has been made in view of the problems in the above conventional technique, and an object thereof is to improve the productivity and work efficiency at the time of recovery from a jam which occurs in one of sheet feeding units when sheets fed from two or more sheet feeding units are to be discharged to a downstream side through a merging point.

To achieve the abovementioned object, according to an aspect, a sheet conveyance apparatus which conveys sheets fed from a first sheet feeding unit and sheets fed from a second sheet feeding unit to a merging point, inserts the sheets fed from the first sheet feeding unit into the sheets fed from the second sheet feeding unit in a predetermined order at the merging point, and discharges the sheets fed from the first sheet feeding unit and the sheets fed from the second sheet feeding unit to a downstream side through the merging point reflecting one aspect of the present invention comprises: a jam detecting unit configured to detect a jam of a sheet in the first sheet feeding unit; and a control unit configured to newly feed, when the jam is detected by the jam detecting unit, sheets which are before the predetermined order, in which a sheet causing the jam is supposed to be inserted, and have not been fed from the second sheet feeding unit, and convey the newly fed sheets to the downstream side through the merging point.

According to an invention of Item. 2, in the sheet conveyance apparatus of Item. 1, the first sheet feeding unit preferably comprises a primary sheet-feeding conveyance unit configured to separate sheets one by one and convey the sheets to a resist part, and a secondary sheet-feeding conveyance unit configured to convey the sheets from the resist part to the merging point, and the jam detecting unit preferably detects a jam of a sheet in the primary sheet-feeding conveyance unit.

According to an invention of Item. 3, in the sheet conveyance apparatus of Item. 1 or 2, the sheets to be newly fed from the second sheet feeding unit are preferably until a sheet right before the predetermined order in which the sheet causing the jam is supposed to be inserted.

According to an invention of Item. 4, in the sheet conveyance apparatus of Item. 1 or 2, the sheets to be newly fed from the second sheet feeding unit are preferably until a sheet right before a top sheet in a job or a set including the sheet causing the jam.

To achieve the abovementioned object, according to an aspect, an image forming apparatus reflecting one aspect of the present invention comprises: a sheet conveyance apparatus of any one of Items. 1 to 4; and an image forming unit configured to form an image on a sheet, wherein the first sheet feeding unit is an interleaf inserting apparatus which inserts an interleaf into sheets on which the image is formed by the image forming unit.

According to an invention of Item. 6, in the image forming apparatus of Item. 5, the first sheet feeding unit is preferably positioned downstream of the image forming unit, and the second sheet feeding unit is preferably positioned upstream of the image forming unit.

According to an invention of Item. 7, in the image forming apparatus of Item. 5 or 6, at a point when the jam is detected by the jam detecting unit, when sheets after the predetermined order in which the sheet causing the jam is supposed to be inserted have been fed from the second sheet feeding unit, the control unit preferably stops or discharges the fed sheets after the predetermined order to a discharge destination different from a discharge destination of sheets before the predetermined order.

To achieve the abovementioned object, according to an aspect, an image forming system which conveys sheets fed from an interleaf inserting apparatus and sheets fed from an image forming apparatus to a merging point, inserts the sheets fed from the interleaf inserting apparatus into the sheets on which an image is formed by the image forming apparatus in a predetermined order at the merging point, and discharges the sheets fed from the interleaf inserting apparatus and the sheets fed from the image forming apparatus to a downstream side through the merging point reflecting one aspect of the present invention comprises: a jam detecting unit configured to detect a jam of a sheet in the interleaf inserting apparatus; and a control unit configured to newly feed, when the jam is detected by the jam detecting unit, sheets which are before the predetermined order, in which a sheet causing the jam is supposed to be inserted, and have not been fed from the image forming apparatus, and convey the newly fed sheets to the downstream side through the merging point.

To achieve the abovementioned object, according to an aspect, there is provided a non-transitory recording medium storing a computer readable control program to control a sheet conveyance apparatus, and the program reflecting one aspect of the present invention causes a computer to execute: conveying sheets fed from a first sheet feeding unit and sheets fed from a second sheet feeding unit to a merging point; inserting the sheets fed from the first sheet feeding unit into the sheets fed from the second sheet feeding unit in a predetermined order at the merging point; discharging the sheets fed from the first sheet feeding unit and the sheets fed from the second sheet feeding unit to a downstream side through the merging point; detecting a jam of a sheet in the first sheet feeding unit; newly feeding, when the jam is detected, sheets before the predetermined order, in which a sheet causing the jam is supposed to be inserted, and have not been fed from the second sheet feeding unit; and conveying the newly fed sheets to the downstream side through the merging point.

According to an invention of Item. 10, in the non-transitory recording medium storing the program of Item. 9, the sheets to be newly fed from the second sheet feeding unit are preferably until a sheet right before the predetermined order in which the sheet causing the jam is supposed to be inserted.

According to an invention of Item. 11, in the non-transitory recording medium storing the program of Item. 9, the sheets to be newly fed from the second sheet feeding unit are preferably until a sheet right before a top sheet in a job or a set including the sheet causing the jam.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 is a flowchart illustrating interleaf feeding control processing to be performed in the interleaf inserting apparatus;

DESCRIPTION OF THE PREFERRED EMBODIMENTS

Hereinafter, an embodiment of an image forming system according to the present invention will be described with reference to the drawings. However, the scope of the invention is not limited to the illustrated examples.

[Configuration of Image Forming System]

Figure 1:
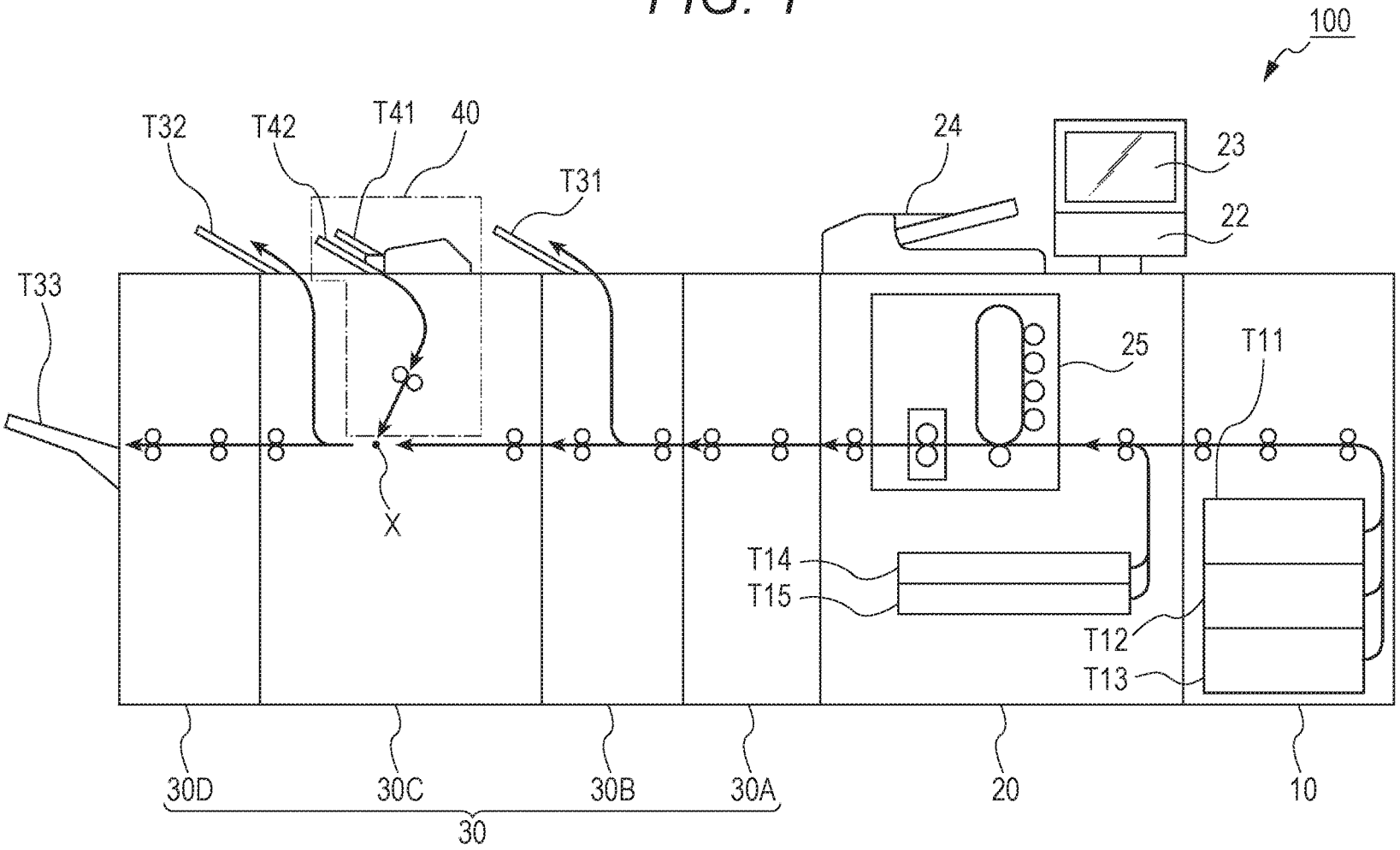
FIG. 1 is a diagram schematically illustrating an image forming system according to an embodiment of the present invention.

FIG. 1 schematically illustrates a configuration of an image forming system 100. As illustrated in FIG. 1, the image forming system 100 includes a sheet feeding apparatus 10, an image forming apparatus 20, a post-processing apparatus 30, and an interleaf inserting apparatus 40. In the image forming system 100, the interleaf inserting apparatus 40 inserts interleaves into sheet conveyed from the image forming apparatus 20 by merging the interleaves (including front cover sheets and back cover sheets) with the sheets.

The sheet feeding apparatus 10 includes large-capacity sheet feeding trays T11 to T13, and feeds sheets stored in the sheet feeding trays T11 to T13 to the image forming apparatus 20. The sheet feeding trays T11 to T13 each store sheets of predetermined sheet types and sizes.

The image forming apparatus 20 includes an operation unit 22, a display unit 23, an image reading unit 24, an image forming unit 25, and sheet feeding trays T14 and T15. The image forming apparatus 20 forms an image on a sheet fed from the sheet feeding apparatus 10 or a sheet fed from the sheet feeding trays T14 and T15. The sheet feeding trays T14 and T15 each store sheets of predetermined sheet types and sizes. Hereinafter, the sheets fed from the sheet feeding trays T11 to T15 are also referred to as image forming sheets. The image forming sheets stored in the sheet feeding trays T11 to T15 are fed to the image forming unit 25. In other words, the sheet feeding trays T11 to T15 are positioned upstream of the image forming unit 25.

Figure 3:
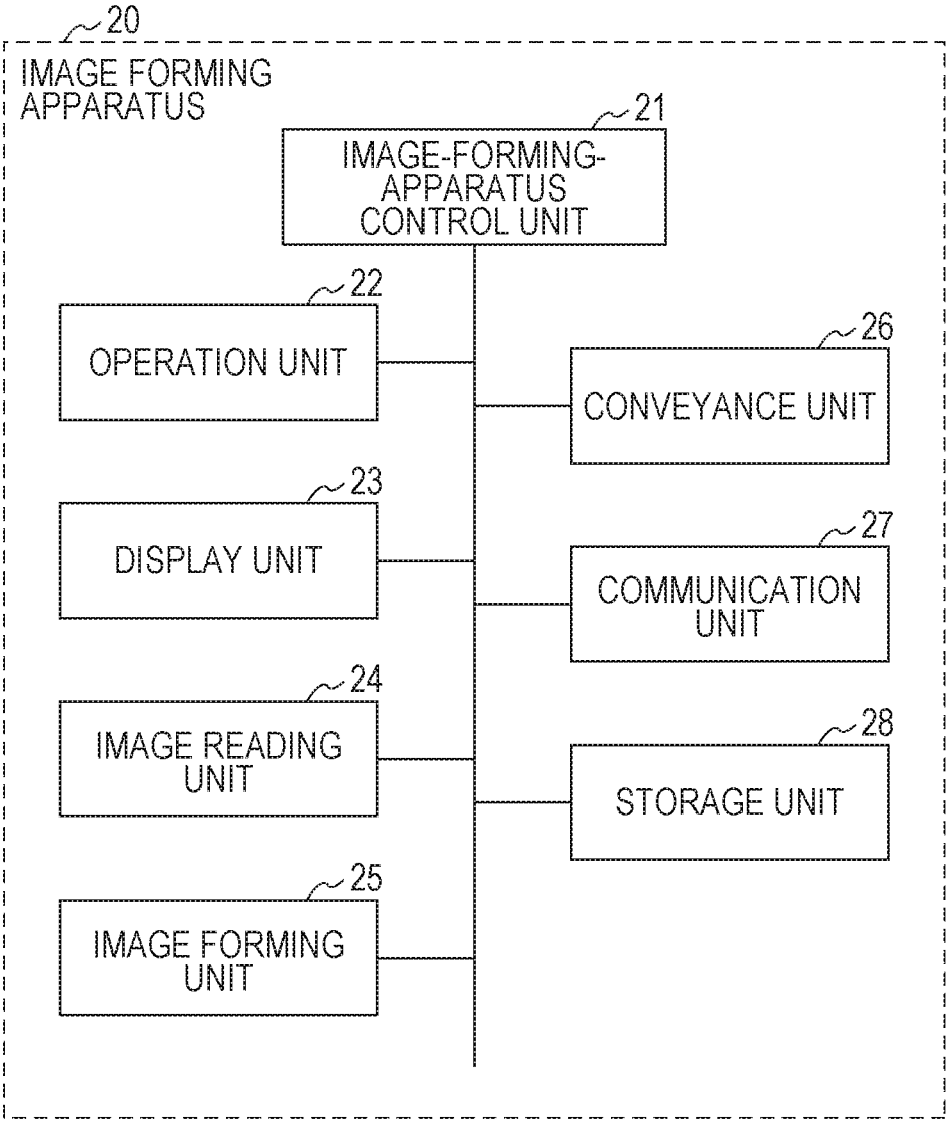
FIG. 3 is a block diagram illustrating a functional configuration of an image forming apparatus.

The operation unit 22 includes a touch panel formed so as to cover a display screen of the display unit 23 and various operation buttons, such as numeric buttons and a start button, and outputs operation signals based on a user's operation to the image-forming-apparatus control unit 21 (see FIG. 3).

The display unit 23 is configured by a liquid crystal display (LCD), and displays various screens according to instructions of display signals input from the image-forming-apparatus control unit 21.

The image reading unit 24 includes an automatic document feeder (ADF) and a scanner, and outputs image data obtained by reading document image to the image-forming-apparatus control unit 21.

The image forming unit 25 forms an image on the image forming sheets based on the image data read by the image reading unit 24 or image data received from an external apparatus.

The post-processing apparatus 30 is configured by post-processing units 30A, 30B, 30C, and 30D, and performs, as needed, post-processing, such as folding processing, punching processing, binding processing, or cutting processing, to the image forming sheet conveyed from the image forming apparatus 20 and the interleaves inserted from the interleaf inserting apparatus 40. The post-processing apparatus 30 includes sheet discharging trays T31 to T33, and discharges sheet bundles or booklets generated by the image forming system 100 to the sheet discharging trays T31 to T33. The sheet discharging trays T31, T32 and T33 are provided at the post-processing units 30B, 30C, and 30D respectively.

The interleaf inserting apparatus 40 is positioned downstream of the image forming unit 25 of the image forming apparatus 20. The interleaf inserting apparatus 40 includes loading trays T41 and T42 which loads interleaves, and inserts the interleaves into the image forming sheet conveyed inside the post-processing apparatus 30. The interleaves are supplied to an image-forming-sheet conveying path at a merging point X, and inserted into the image forming sheets.

Figure 2:
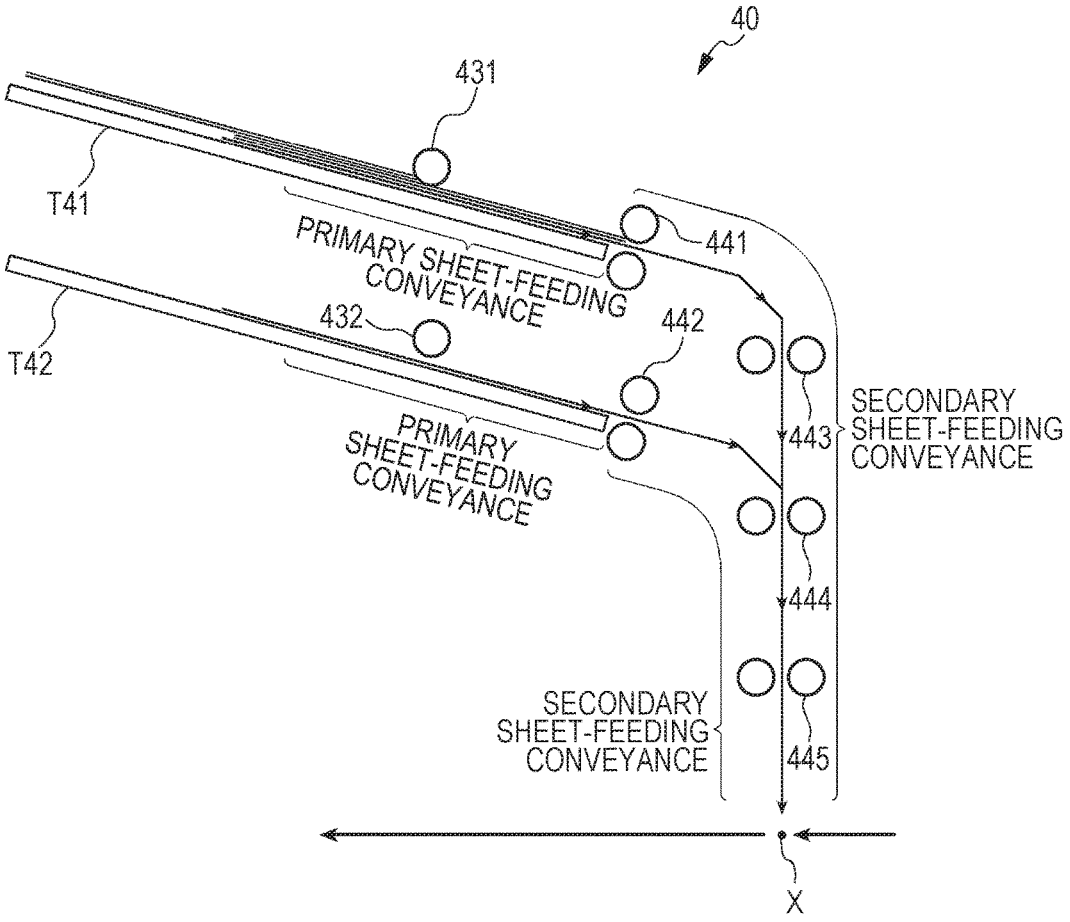
FIG. 2 is an enlarged diagram schematically illustrating a sheet feeding part of an interleaf inserting apparatus.

FIG. 2 is an enlarged diagram schematically illustrating a sheet feeding part of the interleaf inserting apparatus 40. The interleaf inserting apparatus 40 includes the loading trays T41 and T42, separating rollers 431 and 432, resist parts 441 and 442, and conveying rollers 443, 444, and 445.

The interleaves loaded on the loading trays T41 and T42 are separated and picked up one by one by the separating rollers 431 and 432, and conveyed to the resist parts 441 and 442. The conveyance of the leading edge of an interleaf in the conveying direction from the separating rollers 431 and 432 to the resist parts 441 and 442 is referred to as "primary sheet-feeding conveyance". The time required for the primary sheet-feeding conveyance (pre-feeding time) greatly varies according to the kinds and the loaded number of interleaves, the abrasion degree of the separating rollers 431 and 432, double-trying, or the like.

The resist parts 441 and 442 are configured by resist rollers which adjust the position of the leading edge of the sheet. The conveyance from the resist parts 441 and 442 to the merging point X with the image-forming-sheet conveying path is referred to as "secondary sheet-feeding conveyance". The secondary sheet-feeding conveyance is stably performed by the resist parts 441 and 442, and the nip parts of the conveying rollers 443 to 445, and the time required for the secondary sheet-feeding conveyance (actual sheet-feeding time) hardly varies.

In other words, the interleaf-feeding in the interleaf inserting apparatus 40 includes two steps of the primary sheet-feeding conveyance which has an unstable factor in time and the secondary sheet-feeding conveyance which does not have an unstable factor in time.

The image forming system 100 is a sheet conveyance apparatus which conveys sheets fed from the interleaf inserting apparatus 40 as a first sheet feeding unit and sheets fed from the sheet feeding trays T11 to T15 as a second sheet feeding unit to a merging point X, inserts the sheet fed from the interleaf inserting apparatus 40 into the sheets fed from the sheet feeding trays T11 to T15 in a predetermined order at the merging point X, and discharges the sheet fed from the interleaf inserting apparatus 40 and the sheets fed from the sheet feeding trays T11 to T15 to a downstream side through the merging point X.

[Configuration of Image Forming Apparatus]

FIG. 3 is a block diagram illustrating a functional configuration of the image forming apparatus 20. As illustrated in FIG. 3, the image forming apparatus 20 includes an image-forming-apparatus control unit 21, an operation unit 22, a display unit 23, an image reading unit 24, an image forming unit 25, a conveyance unit 26, a communication unit 27, and a storage unit 28. Note that, a description for the functional unit which has been described will be omitted.

The image-forming-apparatus control unit 21 includes a central processing unit (CPU), a read only memory (ROM), and a random access memory (RAM). The CPU reads various kinds of processing programs stored in the ROM, expands the programs in the RAM, and integrally controls the operations of the units of the image forming apparatus 20 according to the expanded programs.

The conveyance unit 26 includes a conveying roller to convey the sheets, and conveys the sheets inside the image forming apparatus 20. Specifically, the conveyance unit 26 conveys the image forming sheets fed from the sheet feeding apparatus 10 or the sheet feeding trays T14 and T15 to the image forming unit 25, and conveys the image forming sheets, on which an image is formed by the image forming unit 25, to the post-processing apparatus 30.

The communication unit 27 is an interface to transmit and receive data between external apparatuses, such as the post-processing apparatus 30 and the interleaf inserting apparatus 40 which are connected through a network.

The storage unit 28 is configured by a hard disk or a flash memory, and stores various kinds of data. For example, the storage unit 28 stores job information. The job information is to be input to the image forming apparatus 20 to form an image. The job information includes data for each page including image data, image forming conditions of the image data, and setting information, such as post-processing conditions. Furthermore, the job information includes information indicating predetermined orders to insert the interleaves into the image forming sheets.

The image-forming-apparatus control unit 21 transmits, through the communication unit 27, the job information to the post-processing apparatus 30 and the interleaf inserting apparatus 40.

When jam detection information indicating that a jam is detected is notified by the interleaf inserting apparatus 40, the image-forming-apparatus control unit 21 newly feeds the sheets, which are before the predetermined order, in which the sheet causing the jam is supposed to be inserted, and have not been fed from the sheet feeding trays T11 to T15, and conveys the newly fed sheet to the downstream side. Here, when a mode for performing the processing in units of sheets is selected, the sheets to be newly fed from the sheet feeding trays T11 to T15 are image forming sheets until the sheet right before the predetermined order in which the sheet causing the jam is supposed to be inserted. When a mode for performing in units of jobs, the sheets to be newly fed from the sheet feeding trays T11 to T15 are image forming sheets until the sheet right before the top sheet of the job including the sheet causing the jam. When a mode for performing in units of sets, the sheets to be newly fed from the sheet feeding trays T11 to T15 are image forming sheets until the sheet right before the top sheet of the set including the sheet causing the jam.

[Configuration of Post-Processing Apparatus]

Figure 4:
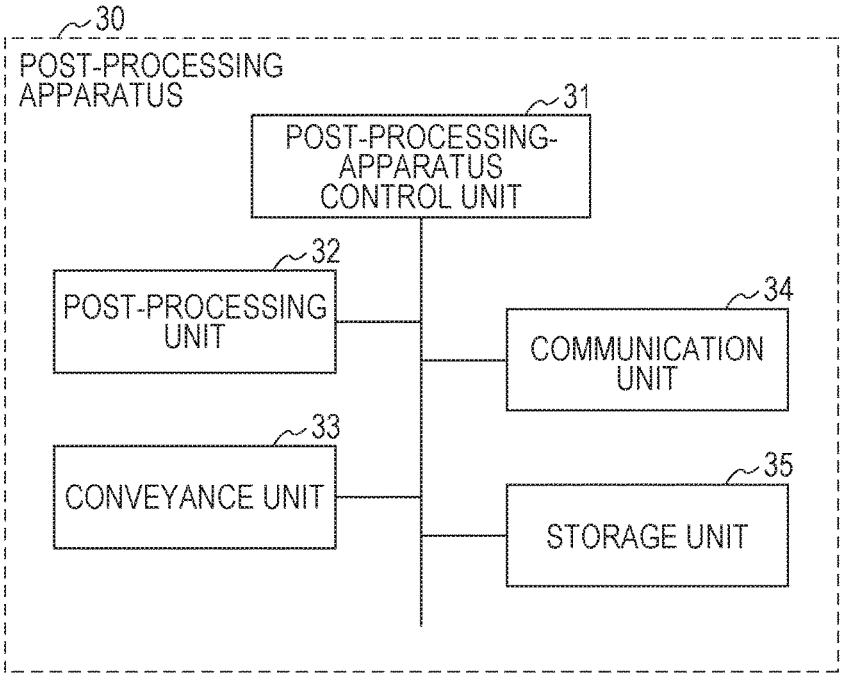
FIG. 4 is a block diagram illustrating a functional configuration of a post-processing apparatus.

FIG. 4 is a block diagram illustrating a functional configuration of the post-processing apparatus 30. As illustrated in FIG. 4, the post-processing apparatus 30 includes a post-processing-apparatus control unit 31, a post-processing unit 32, a conveyance unit 33, a communication unit 34, and a storage unit 35.

The post-processing-apparatus control unit 31 is configured by a CPU, a ROM, and a RAM. The CPU reads various kinds of processing programs stored in the ROM, expands the programs in the RAM, and integrally controls the operations of the units of the post-processing apparatus 30 according to the expanded programs.

The post-processing unit 32 performs post-processing, such as folding processing, punching processing, binding processing, or cutting processing, to the sheets. The conveyance unit 33 includes a conveying roller to convey the sheets, and conveys the sheets inside the post-processing apparatus 30. The communication unit 34 is an interface to transmit and receive data between external apparatuses, such as the image forming apparatus 20 and the interleaf inserting apparatus 40 which are connected through a network. The storage unit 35 is configured by a hard disk or a flash memory, and stores various kinds of data.

When the sheets after the predetermined order in which the sheet causing a jam is supposed to be inserted have been fed from the sheet feeding trays T11 to T15 at the point when a jam detecting unit 47 (see FIG. 5) detects the jam, the post-processing-apparatus control unit 31 discharges the fed sheet after the predetermined order to a discharge destination different from the discharge destination of the sheets before the predetermined order. When there is no discharge destination different from the discharge destination of the sheets before the predetermined order, the post-processing-apparatus control unit 31 stops the fed sheets after the predetermined order.

[Configuration of Interleaf Inserting Apparatus]

Figure 5:
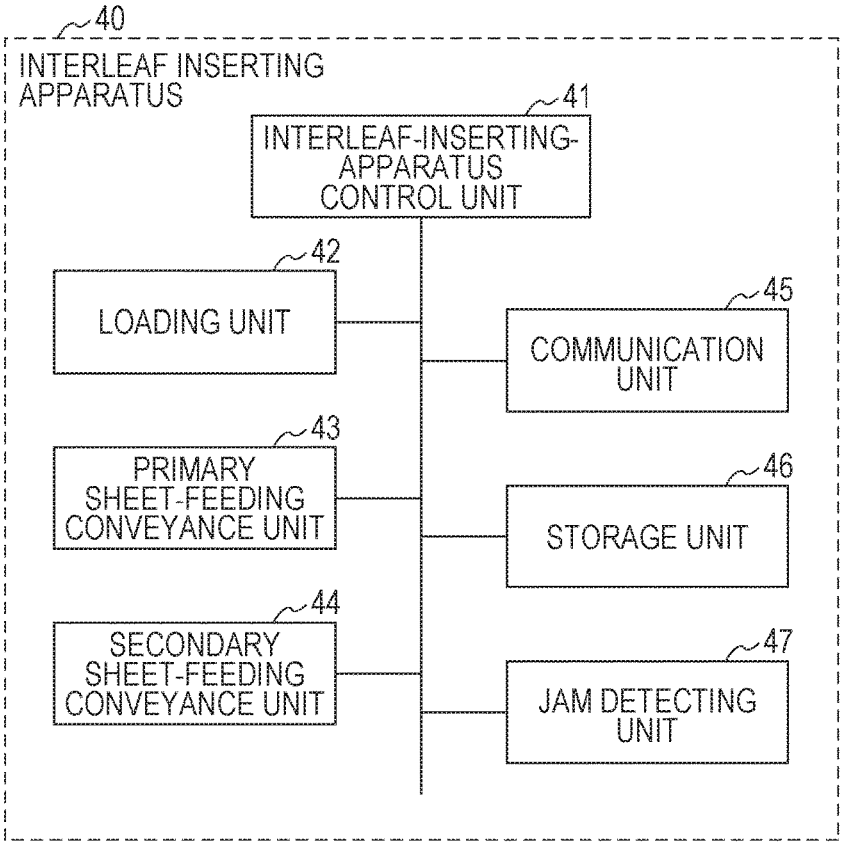
FIG. 5 is a block diagram illustrating a functional configuration of the interleaf inserting apparatus.

FIG. 5 is a block diagram illustrating a functional configuration of the interleaf inserting apparatus 40. As illustrated in FIG. 5, the interleaf inserting apparatus 40 includes an interleaf-inserting-apparatus control unit 41, a loading unit 42, a primary sheet-feeding conveyance unit 43, a secondary sheet-feeding conveyance unit 44, a communication unit 45, a storage unit 46, and a jam detecting unit 47.

The interleaf-inserting-apparatus control unit 41 is configured by a CPU, a ROM, and a RAM. The CPU reads various kinds of processing programs stored in the ROM, expands the programs in the RAM, and integrally controls the operations of the units of the interleaf inserting apparatus 40 according to the expanded programs.

The loading unit 42 includes the loading trays T41 and T42. On the loading trays T41 and T42, interleaves, such as thick paper or colored paper, are loaded.

The primary sheet-feeding conveyance unit 43 includes the separating rollers 431 and 432, separates and picks up the interleaves loaded on the loading unit 42 one by one, and conveys the interleaves to the resist parts 441 and 442. The secondary sheet-feeding conveyance unit 44 includes the conveying rollers 443 to 445, and conveys the interleaves from the resist parts 441 and 442 to the merging point X with the image forming sheets.

The communication unit 45 is an interface to transmit and receive data between external apparatuses, such as the image forming apparatus 20 and the post-processing apparatus 30 which are connected through a network. The storage unit 46 is configured by a hard disk or a flash memory, and stores various kinds of data.

The jam detecting unit 47 is configured by multiple sensors provided at the conveying path in the primary sheet-feeding conveyance unit 43 of the interleaf inserting apparatus 40. The sensors are to detect whether there is a sheet on the conveying path. The jam detecting unit 47 detects a jam (primary sheet-feeding jam) during the primary sheet-feeding conveyance unit 43 of the interleaf inserting apparatus 40 separates and picks up the sheets one by one, and outputs the detection result to the interleaf-inserting-apparatus control unit 41.

When there is a next interleaf to be inserted, the interleaf-inserting-apparatus control unit 41 controls the primary sheet-feeding conveyance unit 43 to perform the primary sheet-feeding conveyance of the interleaf. Furthermore, when the timing to start the secondary sheet-feeding conveyance of the interleaf comes, the interleaf-inserting-apparatus control unit 41 controls the secondary sheet-feeding conveyance unit 44 to perform the secondary sheet-feeding conveyance of the interleaf. In other words, the interleaf-inserting-apparatus control unit 41 asynchronously (independently) controls the primary sheet-feeding conveyance unit 43 and the secondary sheet-feeding conveyance unit 44.

When the jam detecting unit 47 detects the jam in the primary sheet-feeding conveyance unit 43, the interleaf-inserting-apparatus control unit 41 notify the image-forming-apparatus control unit 21 through the communication unit 45 of the jam detection information indicating that the jam is detected. Furthermore, when the timing to start the secondary sheet-feeding conveyance of the interleaf causing a jam while the jam is being detected, the interleaf-inserting-apparatus control unit 41 notifies the image-forming-apparatus control unit 21 and the post-processing-apparatus control unit 31 through the communication unit 45 of the jam occurrence.

[Operation of Image Forming System]

FIG. 6 is a flowchart illustrating interleaf feeding control processing to be performed in the interleaf inserting apparatus 40. This processing is to be performed at the timing when the primary sheet-feeding conveyance of the interleaf can be performed, that is, when the interleaf is to be inserted, and is implemented by software processing in cooperation of the CPU of the interleaf-inserting-apparatus control unit 41 and the programs stored in the ROM.

First, the interleaf-inserting-apparatus control unit 41 starts the primary sheet-feeding conveyance of the interleaf loaded on the loading unit 42 by controlling the primary sheet-feeding conveyance unit 43 (step S1). Next, the interleaf-inserting-apparatus control unit 41 determines whether the primary sheet-feeding conveyance of the interleaf has been completed by the primary sheet-feeding conveyance unit 43 (step S2). For example, a sensor to detect the presence of a sheet is provided near the resist parts 441 and 442, and when the sensor detects that the leading edge of the interleaf in the conveying direction reaches the resist parts 441 and 442, the interleaf-inserting-apparatus control unit 41 determines that the primary sheet-feeding conveyance of the interleaf has been completed by the primary sheet-feeding conveyance unit 43.

When the primary sheet-feeding conveyance of the interleaf has not been completed (step S2; NO), the interleaf-inserting-apparatus control unit 41 determines whether the jam detecting unit 47 has detected a jam in the primary sheet-feeding conveyance (step S3). When the jam detecting unit 47 has not detected a jam in the primary sheet-feeding conveyance (step S3; NO), the processing returns back to step S2.

In step S3, when the jam detecting unit 47 has detected a jam in the primary sheet-feeding conveyance (step S3; YES), the interleaf-inserting-apparatus control unit 41 stops the primary sheet-feeding conveyance of the interleaf (step S4), and stores, in the storage unit 46, the jam detection information indicating that the jam in the primary sheet-feeding conveyance has been detected (step S5) by controlling the primary sheet-feeding conveyance unit 43. Furthermore, the interleaf-inserting-apparatus control unit 41 notifies the image-forming-apparatus control unit 21 through the communication unit 45 of the jam detection information (step S6).

In step S2, when the primary sheet-feeding conveyance of the interleaf has been completed (step S2; YES), or after step S6, the interleaf-inserting-apparatus control unit 41 determines, based on the job information, whether the timing to start the secondary sheet-feeding conveyance of the interleaf comes (step S7). The job information includes a predetermined order to insert the interleaf (the insertion points of the interleaf), and although a jam is caused by the interleaf to be inserted, the interleaf-inserting-apparatus control unit 41 can grasp the timing to start the secondary sheet-feeding conveyance of the interleaf. When the timing to start the secondary sheet-feeding conveyance of the interleaf does not come (step S7; NO), the processing returns back to step S7 and waits until the timing to start the secondary sheet-feeding conveyance comes.

In step S7, when the timing to start the secondary sheet-feeding conveyance of the interleaf comes (step S7; YES), the interleaf-inserting-apparatus control unit 41 determines whether the jam detection information has been stored in the storage unit 46 (step S8). When the storage unit 46 stores the jam detection information (step S8; YES), the interleaf-inserting-apparatus control unit 41 notifies the image-forming-apparatus control unit 21 and the post-processing-apparatus control unit 31 through the communication unit 45 that the jam occurs (jam occurrence) (step S9).

In step S8, when the jam detection information has not been stored in the storage unit 46 (step S8; NO), the interleaf-inserting-apparatus control unit 41 starts the secondary sheet-feeding conveyance of the interleaf (step S10) by controlling the secondary sheet-feeding conveyance unit 44. In other words, the normal sheet conveyance is continued. After step S9 or step S10, the interleaf feeding control processing in the interleaf inserting apparatus 40 is terminated.

Figure 7:
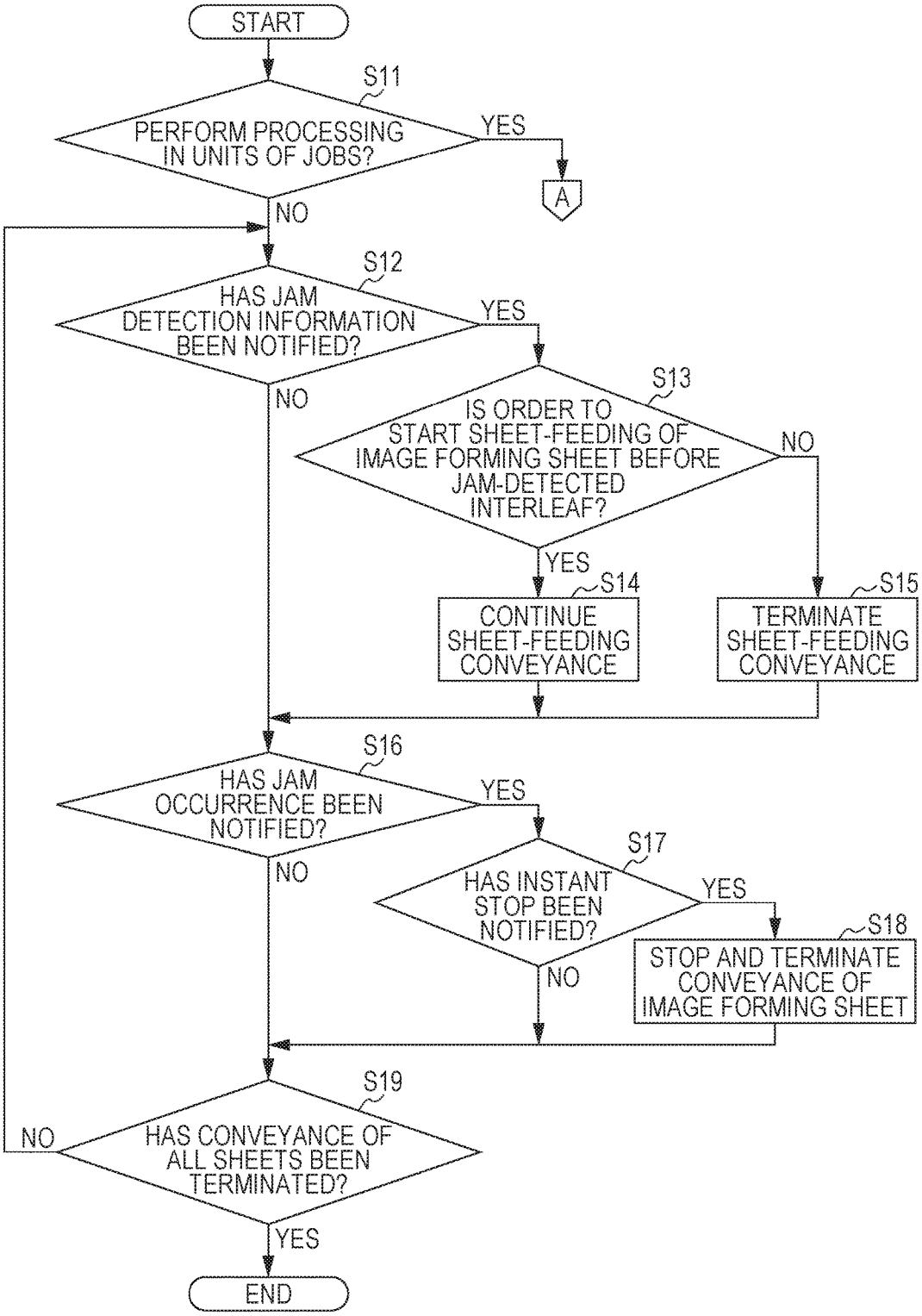
FIG. 7 is a flowchart illustrating sheet-feeding conveying control processing to be performed in the image forming apparatus.
Figure 8:
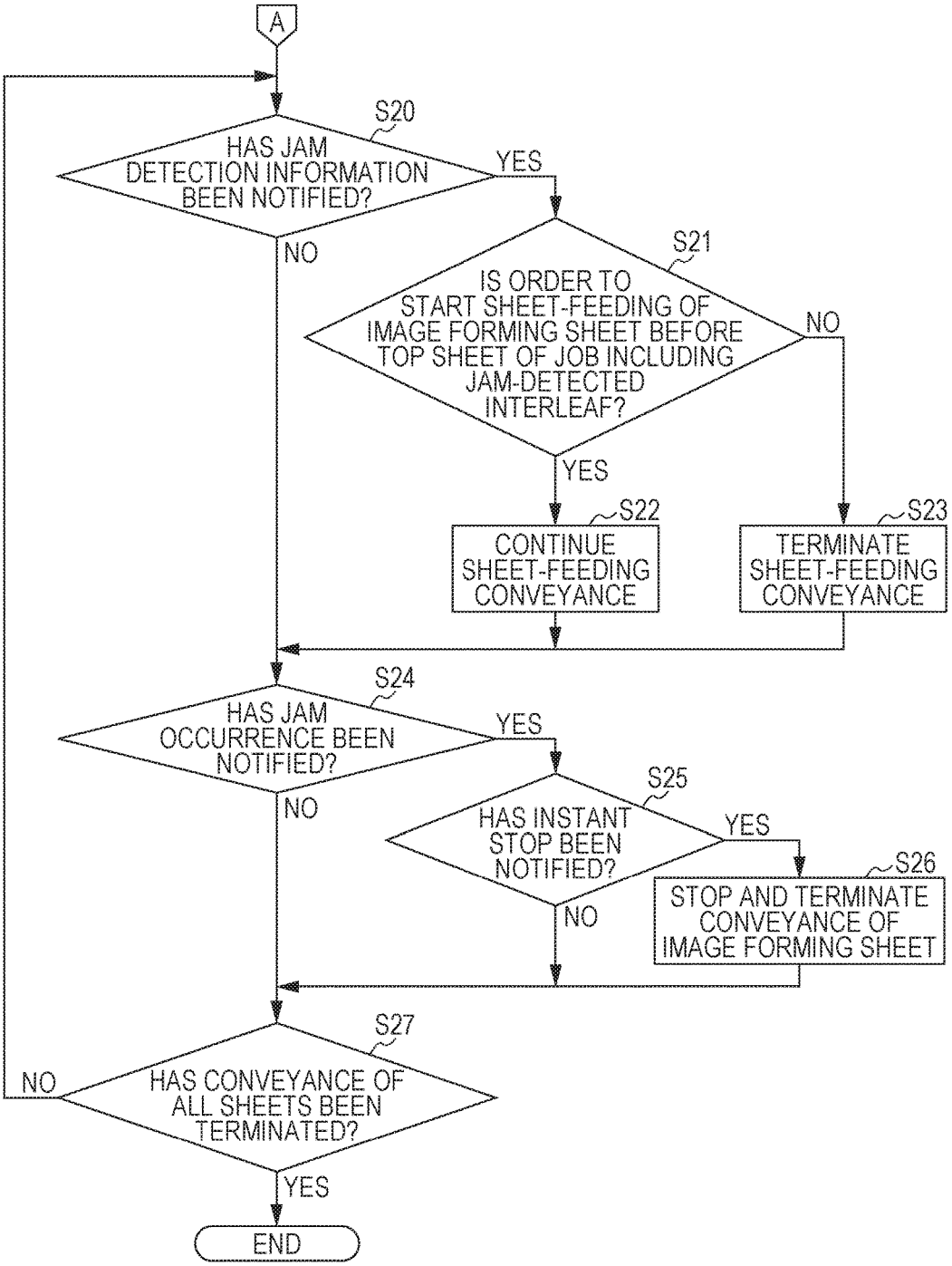
FIG. 8 is a flowchart illustrating the sheet-feeding conveying control processing to be performed in the image forming apparatus.

FIGS. 7 and 8 are flowcharts illustrating sheet-feeding conveying control processing to be performed in the image forming apparatus 20. The processing is implemented by software processing in cooperation of the CPU of the image-forming-apparatus control unit 21 and the programs stored in the ROM. Here, it is assumed that whether the processing is to be performed in units of jobs or in units of sheets has been selected.

First, the image-forming-apparatus control unit 21 determines whether a mode for performing the processing in units of jobs is selected (step S11). Whether the processing is performed in units of jobs has been selected by a user, and the information indicating whether the processing is performed in units of jobs is stored in the storage unit 28 of the image forming apparatus 20.

When the mode for performing the processing in units of jobs is not selected (step S11; NO), that is, when a mode for performing the processing in units of sheets is selected, the image-forming-apparatus control unit 21 determines whether the jam detection information has been notified by the interleaf-inserting-apparatus control unit 41 (step S12).

When the jam detection information has been notified (step S12; YES), the image-forming-apparatus control unit 21 determines, based on the job information, whether the order to start the sheet-feeding of the image forming sheet is before the order in which the sheet causing the jam (hereinafter, referred to as a jam-detected interleaf) is supposed to be inserted (step S13). When the order to start the sheet-feeding of the image forming sheet is before the jam-detected interleaf (step S13; YES), the image-forming-apparatus control unit 21 continues the sheet-feeding and conveyance of new sheets from the sheet feeding trays T14 and T15 or the sheet feeding apparatus 10 by controlling the conveyance unit 26 (step S14). The image-forming-apparatus control unit 21 controls the image forming unit 25 to form an image on the image forming sheet before the jam-detected interleaf (including the newly fed sheet).

In step S13, when the order to start the sheet-feeding of the image forming sheet is not before the jam-detected interleaf (step S13; NO), that is, when the order to start the sheet-feeding of the image forming sheet is after the jam-detected interleaf, the image-forming-apparatus control unit 21 terminates the sheet-feeding and conveyance of the new sheets by controlling the conveyance unit 26 (step S15).

In step S12, when the jam detection information has not been notified (step S12; NO), after step S14 or step S15, the image-forming-apparatus control unit 21 determines whether the jam occurrence has been notified by the interleaf-inserting-apparatus control unit 41 (step S16). When the jam occurrence has been notified (step S16; YES), the image-forming-apparatus control unit 21 determines whether an instant stop has been notified by the post-processing-apparatus control unit 31 (step S17). When the instant stop has been notified (step S17; YES), the image-forming-apparatus control unit 21 stops the conveyance of the image forming sheet by controlling the conveyance unit 26, and terminates the conveyance of the image forming sheet (step S18).

When the jam occurrence has not been notified in step S16 (step S16; NO), the instant stop has not been notified in step S17 (step S17; NO), or after step S18, the image-forming-apparatus control unit 21 determines whether the conveyance of all sheets has been terminated (step S19). When there is a sheet which has not been conveyed (step S19; NO), the processing returns back to step S12 and is repeated. In step S19, when the conveyance of all sheets has been terminated (step S19; YES), the sheet-feeding conveying control processing in the image forming apparatus 20 is terminated.

In step S11, when a mode for performing the processing in units of jobs is selected (step S11; YES), the processing shifts to FIG. 8. The processing from steps S20 to S27 is the same as that from steps S12 to S19 except for that in step S21, and the different processing from that from steps S12 to S19 will be described.

When the jam detection information has been notified by the interleaf-inserting-apparatus control unit 41 (step S20; YES), the image-forming-apparatus control unit 21 determines whether the order to start the sheet-feeding of the image forming sheet is before the top sheet of the job including the jam-detected interleaf (step S21). When the order to start the sheet-feeding of the image forming sheet is before the top sheet of the job including the jam-detected interleaf (step S21; YES), the image-forming-apparatus control unit 21 continues the sheet-feeding and conveyance of new sheets from the sheet feeding trays T14 and T15 or the sheet feeding apparatus 10 by controlling the conveyance unit 26 (step S22). The image-forming-apparatus control unit 21 controls the image forming unit 25 to form an image on the image forming sheet before the top sheet of the job including the jam-detected interleaf (including the newly fed sheet).

In step S21, when the order to start the sheet-feeding of the image forming sheet is not before the top sheet of the job including the jam-detected interleaf (step S21; NO), that is, when the order to start the sheet-feeding of the image forming sheet is after the top sheet of the job including the jam-detected interleaf, the image-forming-apparatus control unit 21 terminates the sheet-feeding and conveyance of the new sheets by controlling the conveyance unit 26 (step S23).

In the image forming apparatus 20, when the operation of the image forming apparatus 20 is stopped due to the jam occurrence, the image-forming-apparatus control unit 21 displays a warning of the jam occurrence on the display unit 23. Note that, the processing from steps S20 to S27 is an example of the case in which the processing is performed in units of jobs, but may be performed in units of sets.

Figure 9:
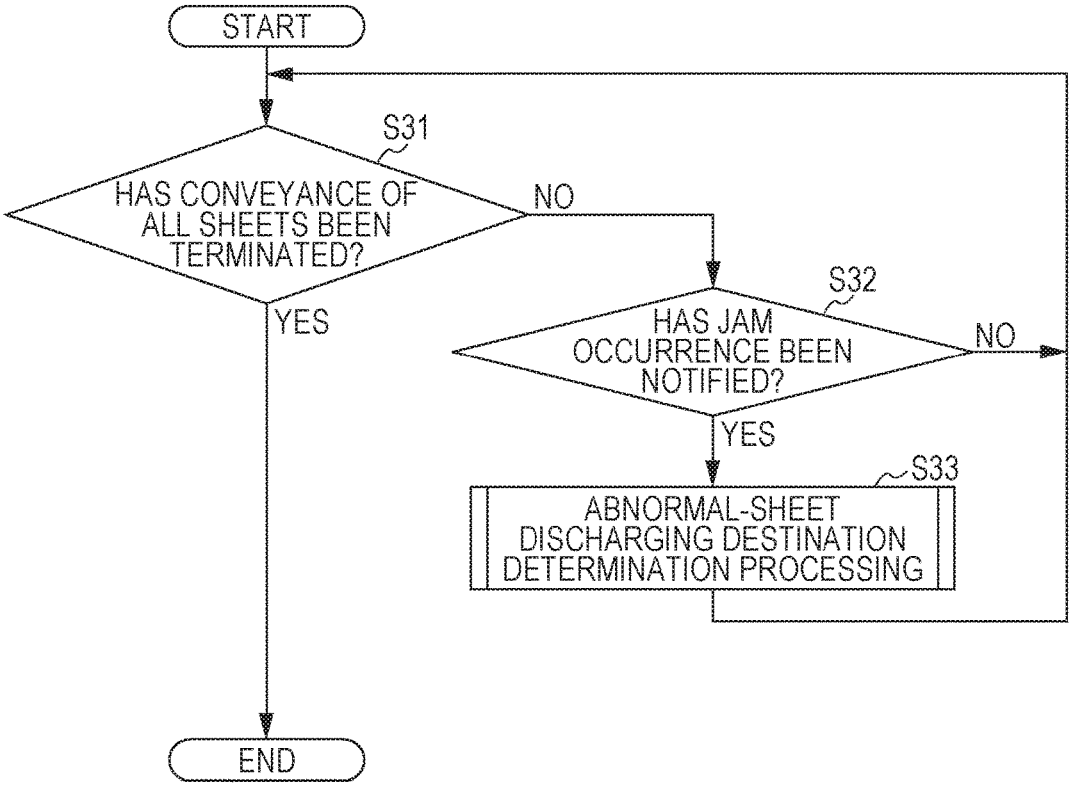
FIG. 9 is a flowchart illustrating sheet conveying control processing to be performed in the post-processing apparatus.

FIG. 9 is a flowchart illustrating sheet conveying control processing to be performed in the post-processing apparatus 30. The processing is implemented by software processing in cooperation of the CPU of the post-processing-apparatus control unit 31 and the programs stored in the ROM.

The post-processing-apparatus control unit 31 determines whether the conveyance of all sheets has been terminated (step S31). When there is a sheet which has not been conveyed (step S31; NO), the post-processing-apparatus control unit 31 determines whether the jam occurrence has been notified by the interleaf-inserting-apparatus control unit 41 (step S32). When the jam occurrence has been notified (step S32; YES), the post-processing-apparatus control unit 31 performs abnormal-sheet discharging destination determination processing (step S33).

In the interleaf inserting apparatus 40, when the timing to start the secondary sheet-feeding conveyance of the interleaf comes (step S7; YES) and the jam detection information has been stored in the storage unit 46 (step S8; YES), the jam occurrence is notified (step S9) (see FIG. 6), and thus the image forming sheet right before a predetermined order, in which the interleaf is supposed to be inserted, has passed the merging point X when the jam occurrence is notified. In the post-processing apparatus 30, that there is a sheet which has not been conveyed (step S31; NO) and the jam occurrence has been notified (step S32; YES) means that there is an image forming sheet after the predetermined order in which the interleaf causing the jam is supposed to be inserted (a sheet to be discharged as an abnormal sheet). In other words, the abnormal-sheet discharging destination determination processing is to be performed when the image forming sheet after the predetermined order, in which the interleaf causing the jam is supposed to be inserted, has been fed from the sheet feeding trays T11 to T15 at the point when the jam detecting unit 47 detects the jam.

Figure 10:
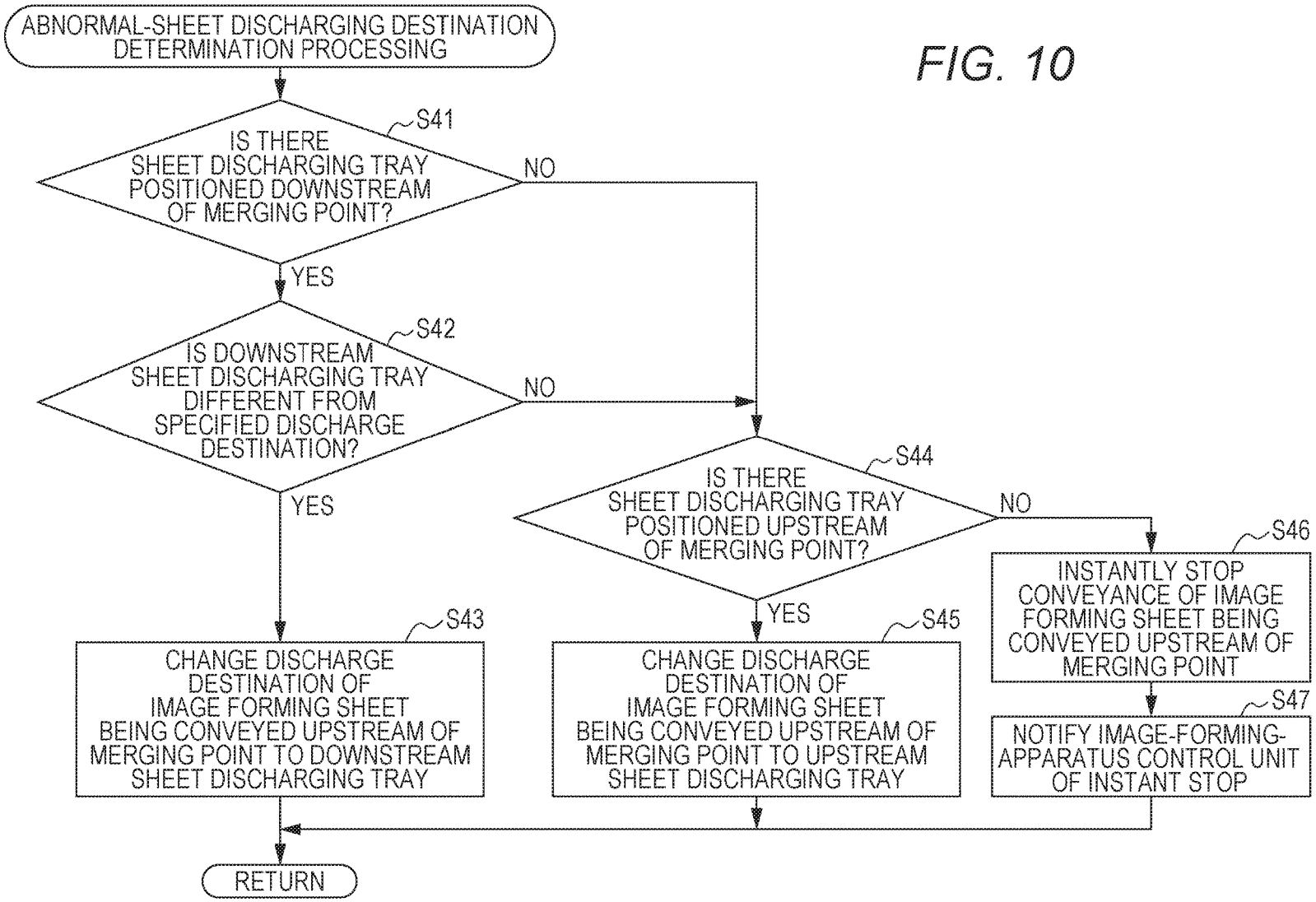
FIG. 10 is a flowchart illustrating abnormal-sheet discharging destination determination processing to be performed in the post-processing apparatus.

Here, the abnormal-sheet discharging destination determination processing will be described with reference to FIG. 10. The post-processing-apparatus control unit 31 determines whether there is a sheet discharging tray positioned downstream of the merging point X (step S41). In the example illustrated in FIG. 1, the sheet discharging trays T32 and T33 are positioned downstream of the merging point X. When there is a sheet discharging tray positioned downstream of the merging point X (step S41; YES), the post-processing-apparatus control unit 31 determines whether the downstream sheet discharging tray is different from the discharge destination specified in the jobs until this point (step S42).

When the downstream sheet discharging tray is different from the specified discharge destination (step S42; YES), the post-processing-apparatus control unit 31 changes the discharge destination of the image forming sheet being conveyed upstream of the merging point X to the downstream sheet discharging tray different from the specified discharge destination by controlling the conveyance unit 33 (step S43).

When there is no sheet discharging tray positioned downstream of the merging point X in step S41 (step S41; NO), or when the downstream sheet discharging tray is the same as the specified discharge destination in step S42 (step S42; NO), the post-processing-apparatus control unit 31 determines whether there is a sheet discharging tray positioned upstream of the merging point X (step S44). In the example illustrated in FIG. 1, the sheet discharging tray T31 is positioned upstream of the merging point X. When there is a sheet discharging tray positioned upstream of the merging point X (step S44; YES), the post-processing-apparatus control unit 31 changes the discharge destination of the image forming sheet being conveyed upstream of the merging point X to the upstream sheet discharging tray by controlling the conveyance unit 33 (step S45).

In step S44, when there is no sheet discharging tray positioned upstream of the merging point X (step S44; NO), the post-processing-apparatus control unit 31 instantly stops the conveyance of the image forming sheet being conveyed upstream of the merging point X (step S46), and notifies the image-forming-apparatus control unit 21 through the communication unit 34 of the instant stop (step S47) by controlling the conveyance unit 33. After step S43, step S45, or step S47, the abnormal-sheet discharging destination determination processing is terminated.

Returning back to FIG. 9, when the jam occurrence has not been notified in step S32 (step S32; NO), or after step S33, the processing returns back to step S31 and is repeated. In step S31, when the conveyance of all sheets has been terminated (step S31; YES), the sheet conveying control processing in the post-processing apparatus 30 is terminated.

[Operation Examples when an Interleaf Jam Occurs]

Operation examples when a jam occurs in the primary sheet-feeding conveyance of an interleaf will be described below. In FIGS. 11 to 16, an interleaf to be inserted as a front cover sheet of the k-th job (job k) is indicated as a "Pk-front", and an interleaf to be inserted as a back cover sheet of the k-th job is indicated as a "Pk-back". The m-th image forming sheet of the k-th job is indicated as "Qk-m". The abscissa indicates time.

Operation Example 1

Figure 11:
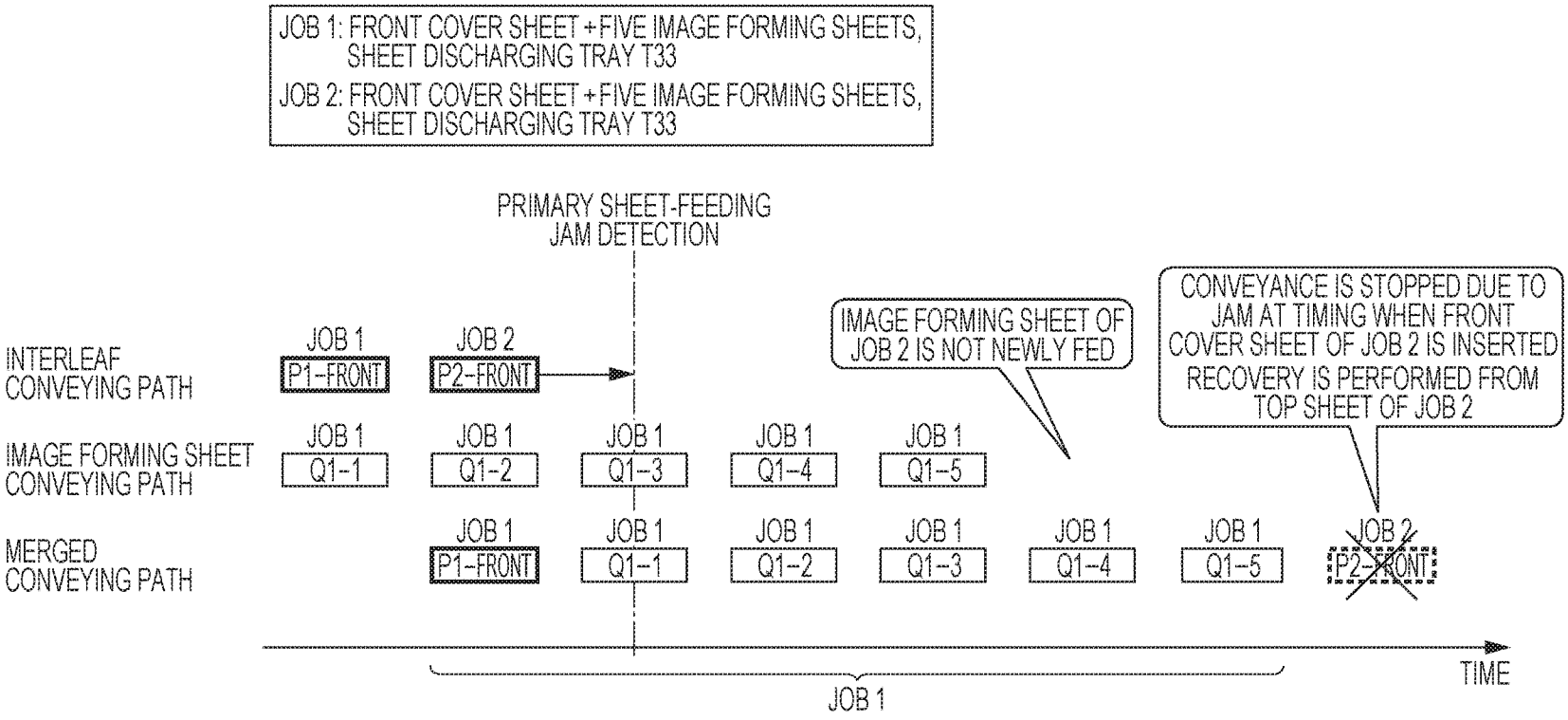
FIG. 11 is a diagram illustrating an example of sheet conveying control in an operation example 1.

FIG. 11 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 1. In the operation example 1, it is instructed to discharge five image forming sheets after a front cover sheet (interleaf) is discharged in the job 1, and to discharge five image forming sheets after a front cover sheet (interleaf) is discharged in the job 2. Furthermore, in the jobs 1 and 2, it is instructed to discharge output objects to the sheet discharging tray T33 of the post-processing unit 30D. Moreover, in the operation example 1, it is selected that the processing is performed in units of jobs.

In the interleaf inserting apparatus 40, when a jam is detected during the primary sheet-feeding conveyance of the front cover sheet of the job 2, the primary sheet-feeding conveyance of the front cover sheet of the job 2 is stopped and the jam detection information is stored. At this time, in the image forming apparatus 20 and the sheet feeding apparatus 10, the sheets until the third image forming sheet of the job 1 (Q1-3) have been fed. In the image forming apparatus 20 and the sheet feeding apparatus 10, the image forming sheets which are not fed included in the job 1 (Q1-4 and Q1-5) are newly fed and the image formation is performed to the sheets. In other words, the sheet-feeding of the image forming sheets included in the job 1 before the front cover sheet of the job 2 in the order is continued, but the image forming sheets included in the job 2 are not newly fed and the sheet-feeding thereof is stopped. At the merging point X of the post-processing apparatus 30, the image forming sheets of the job 1 (Q1-1 to Q1-5) are conveyed following the front cover sheet of the job 1, and the discharging in the job 1 is completed. At the timing when the front cover sheet of the job 2 is inserted, the conveyance is stopped due to the jam. The recovery is performed from the top sheet of the job 2 (P2-front).

Note that, in the operation example 1, the conveying control when the processing is performed in units of sheets is the same as that of FIG. 11. Furthermore, when the processing to be performed in units of sets is selected and a job in which multiple sets of a sheet bundle including a front cover sheet and five image forming sheets is performed, the sheet-feeding and image formation of the fourth and fifth image forming sheets in the first set are continued if a jam is caused by the front cover sheet in the second set while the sheets until the third image forming sheet in the first set have been fed.

Operation Example 2

Figure 12:
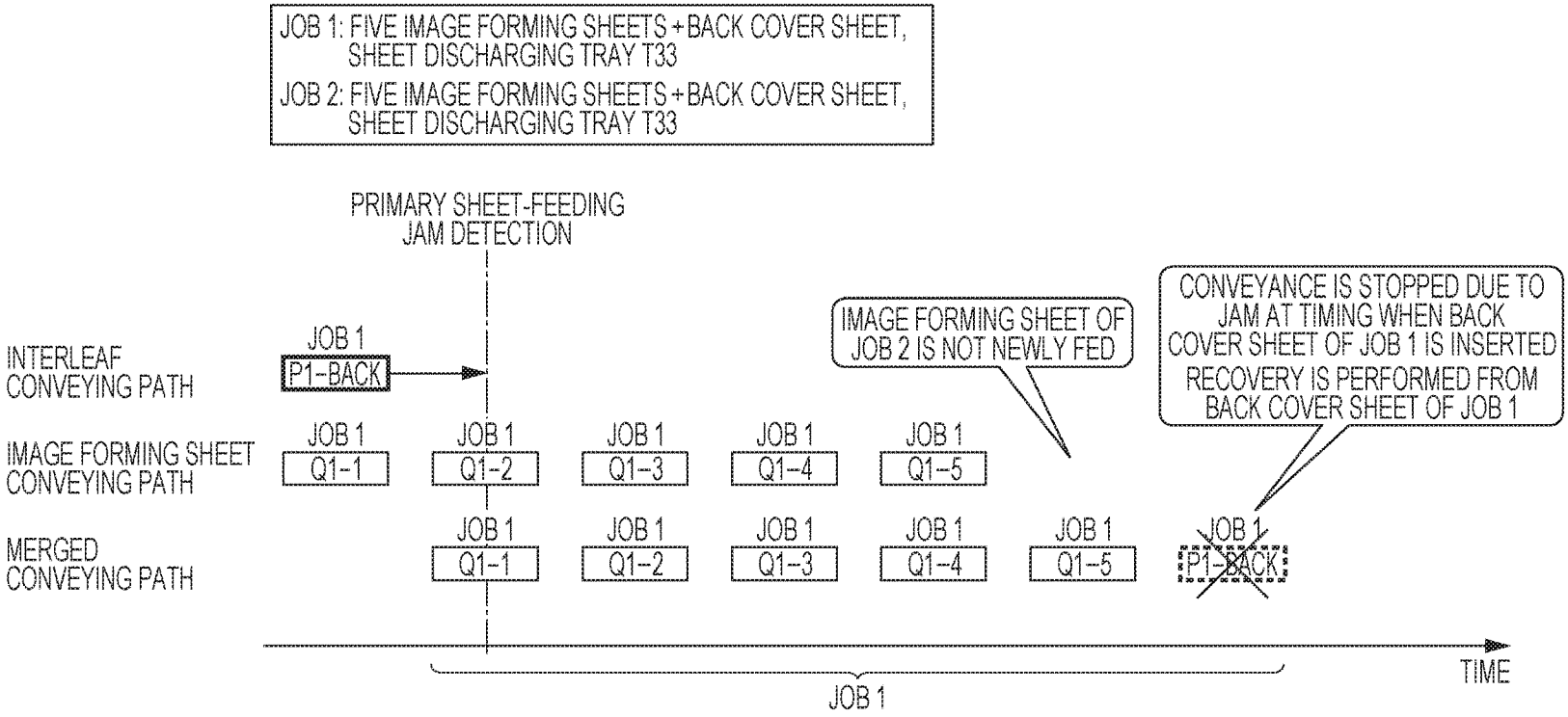
FIG. 12 is a diagram illustrating an example of sheet conveying control in an operation example 2.

FIG. 12 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 2. In the operation example 2, it is instructed to discharge a back cover sheet (interleaf) after five image forming sheets are discharged in the job 1, and to discharge a back cover sheet (interleaf) is discharged after five image forming sheets are discharged in the job 2. Furthermore, in the jobs 1 and 2, it is instructed to discharge output objects to the sheet discharging tray T33 of the post-processing unit 30D. Moreover, in the operation example 2, it is selected that the processing is performed in units of sheets.

In the interleaf inserting apparatus 40, when a jam is detected during the primary sheet-feeding conveyance of the back cover sheet of the job 1, the primary sheet-feeding conveyance of the back cover sheet of the job 1 is stopped and the jam detection information is stored. At this time, in the image forming apparatus 20 and the sheet feeding apparatus 10, the sheets until the second image forming sheet of the job 1 (Q1-2) have been fed. In the image forming apparatus 20 and the sheet feeding apparatus 10, the image forming sheets before the back cover sheet of the job 1 (Q1-3 to Q1-5) in the order are newly fed, and the image formation is performed to the sheets. In other words, the sheet-feeding of the image forming sheets before the back cover sheet of the job 1 in the order is continued, but the image forming sheets included in the job 2 after the back cover sheet of the job 1 in the order are not newly fed and the sheet-feeding thereof is stopped. At the merging point X of the post-processing apparatus 30, the image forming sheets of the job 1 (Q1-1 to Q1-5) are conveyed, and the conveyance is stopped due to the jam at the timing when the back cover sheet of the job 1 is inserted. The recovery is performed from the back cover sheet of the job 1 (P1-back).

Operation Example 3

Figure 13:
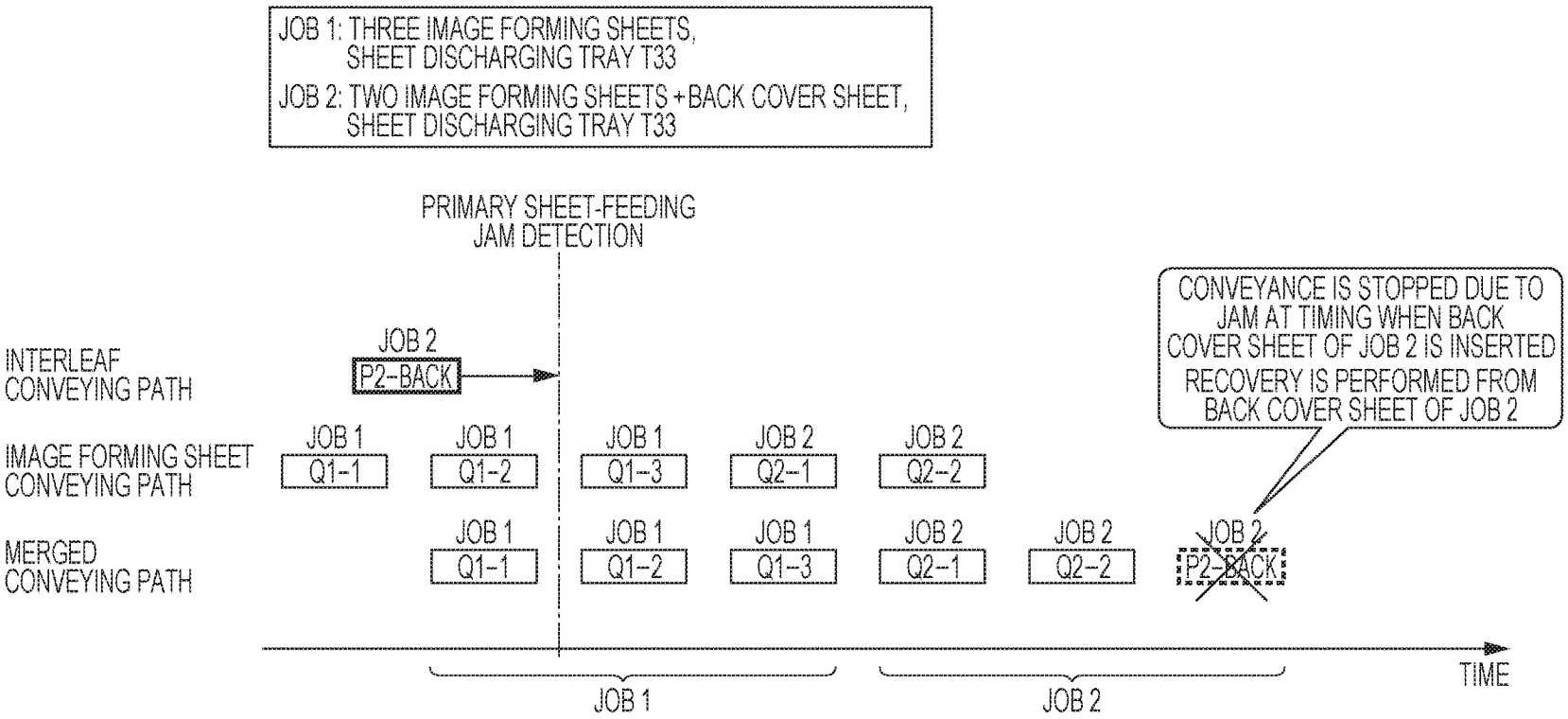
FIG. 13 is a diagram illustrating an example of sheet conveying control in an operation example 3.

FIG. 13 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 3. In the operation example 3, it is instructed to discharge three image forming sheets in the job 1, and to discharge a back cover sheet (interleaf) is discharged after two image forming sheets are discharged in the job 2. Furthermore, in the jobs 1 and 2, it is instructed to discharge output objects to the sheet discharging tray T33 of the post-processing unit 30D. Moreover, in the operation example 3, it is selected that the processing is performed in units of sheets.

In the interleaf inserting apparatus 40, when a jam is detected during the primary sheet-feeding conveyance of the back cover sheet of the job 2, the primary sheet-feeding conveyance of the back cover sheet of the job 2 is stopped and the jam detection information is stored. At this time, in the image forming apparatus 20 and the sheet feeding apparatus 10, the sheets until the second image forming sheet of the job 1 (Q1-2) have been fed. In the image forming apparatus 20 and the sheet feeding apparatus 10, the image forming sheets before the back cover sheet of the job 2 (Q1-3 and Q2-1 to Q2-2) in the order are newly fed, and the image formation is performed to the sheets. In other words, the sheet-feeding of the image forming sheets before the back cover sheet of the job 2 in the order is continued. At the merging point X of the post-processing apparatus 30, the image forming sheets of the job 2 (Q2-1 to Q2-2) are conveyed following the image forming sheets of the job 1 (Q1-1 to 01-3), and the conveyance is stopped due to the jam at the timing when the back cover sheet of the job 2 is inserted. The recovery is performed from the back cover sheet of the job 2 (P2-back).

Operation Example 4

Figure 14:
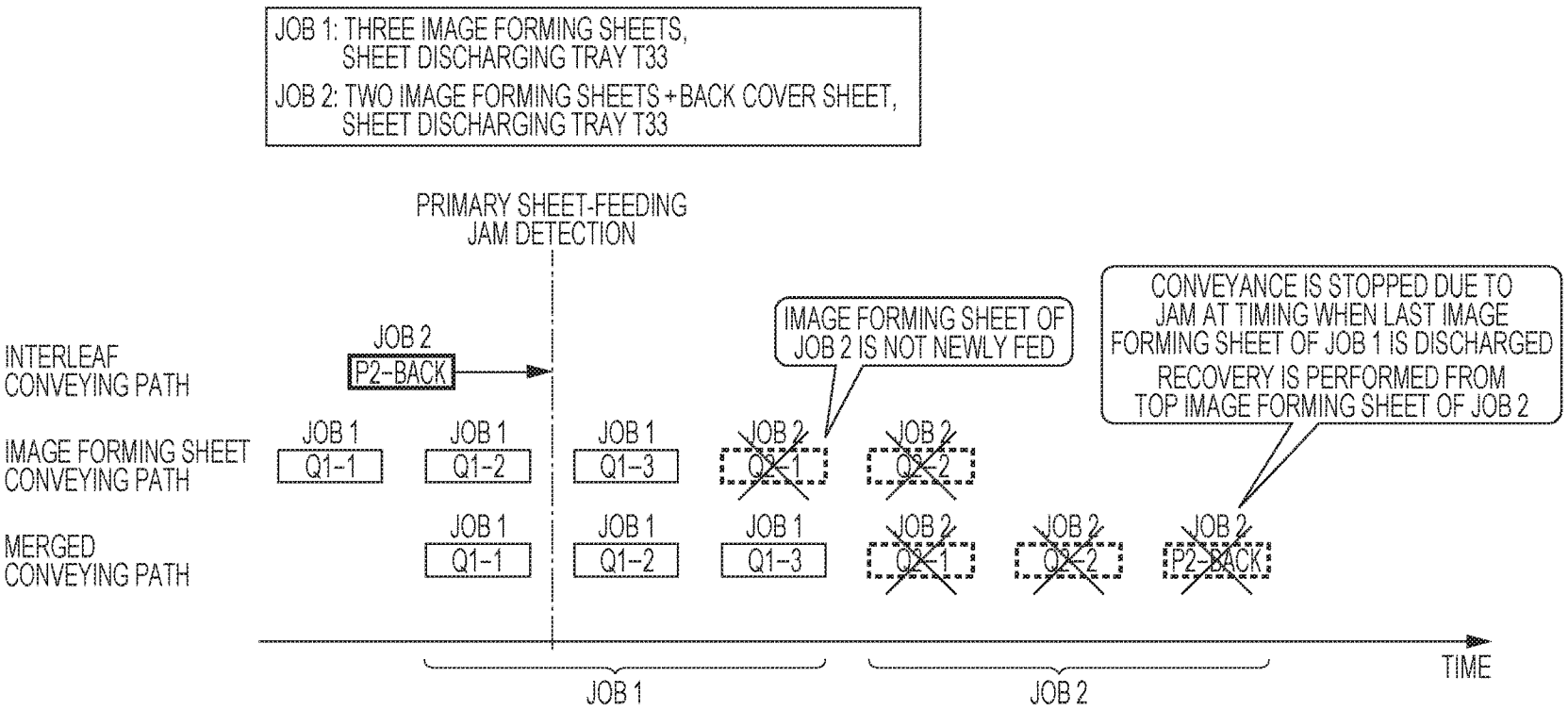
FIG. 14 is a diagram illustrating an example of sheet conveying control in an operation example 4.

FIG. 14 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 4. In the operation example 4, it is instructed to discharge three image forming sheets in the job 1, and to discharge a back cover sheet (interleaf) after two image forming sheets are discharged in the job 2. Furthermore, in the jobs 1 and 2, it is instructed to discharge output objects to the sheet discharging tray T33 of the post-processing unit 30D. Moreover, in the operation example 4, it is selected that the processing is performed in units of jobs.

In the interleaf inserting apparatus 40, when a jam is detected during the primary sheet-feeding conveyance of the back cover sheet of the job 2, the primary sheet-feeding conveyance of the back cover sheet of the job 2 is stopped and the jam detection information is stored. At this time, in the image forming apparatus 20 and the sheet feeding apparatus 10, the sheets until the second image forming sheet of the job 1 (Q1-2) have been fed. In the image forming apparatus 20 and the sheet feeding apparatus 10, the sheet-feeding is continued until the last image forming sheet of the job 1 (Q1-3), and the image formation is performed, but the image forming sheets included in the job 2 are not newly fed and the sheet-feeding thereof is stopped. At the merging point X of the post-processing apparatus 30, the image forming sheets of the job 1 (Q1-1 to Q1-3) are conveyed, and the conveyance is stopped due to the jam when the last image forming sheet of the job 1 is discharged. The recovery is performed from the image forming sheets of the job 2 (Q2-1).

Operation Example 5

Figure 15:
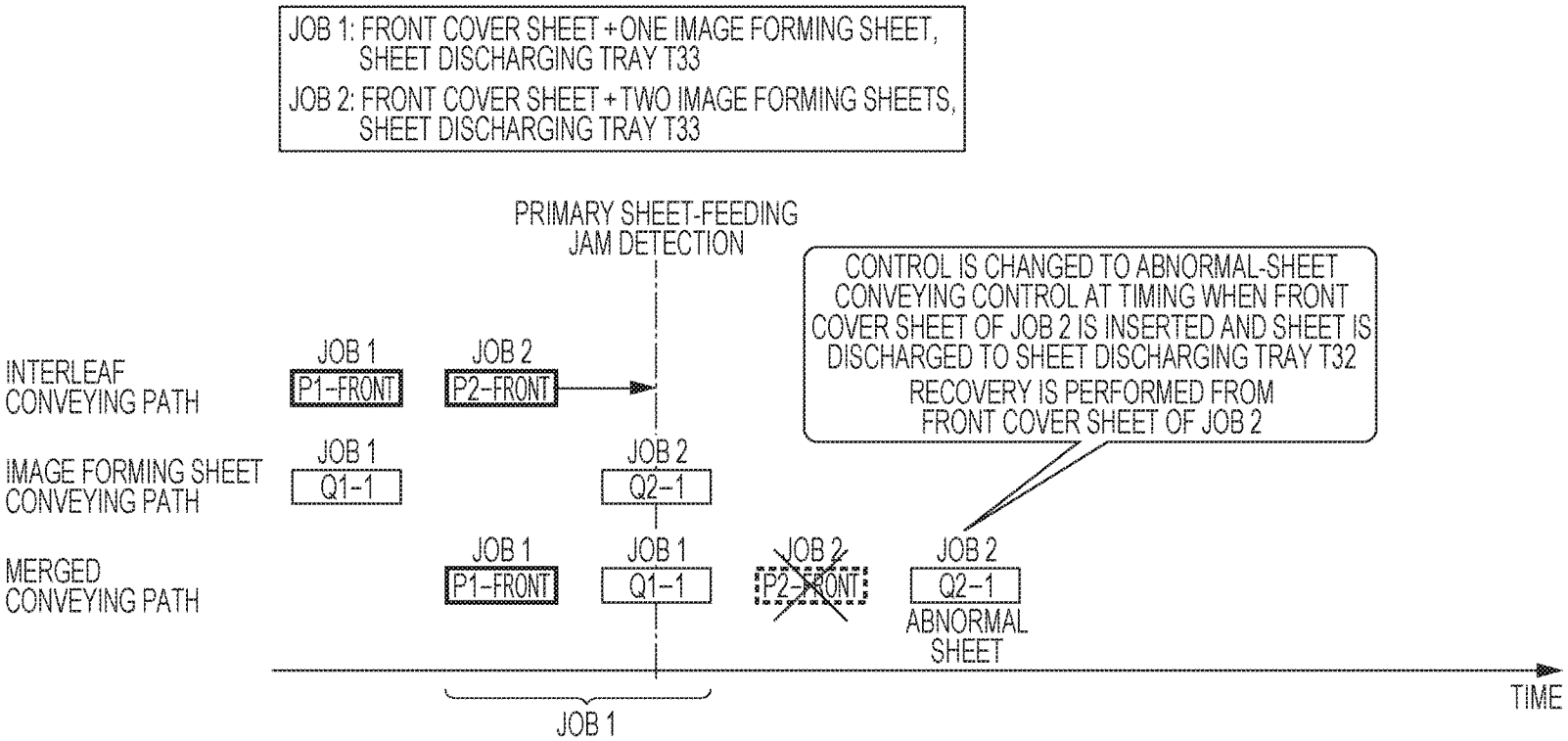
FIG. 15 is a diagram illustrating an example of sheet conveying control in an operation example 5.

FIG. 15 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 5. In the operation example 5, it is instructed to discharge an image forming sheet after a front cover sheet (interleaf) is discharged in the job 1, and to discharge two image forming sheets after a front cover sheet (interleaf) is discharged in the job 2. Furthermore, in the jobs 1 and 2, it is instructed to discharge output objects to the sheet discharging tray T33 of the post-processing unit 30D. Moreover, in the operation example 5, it is selected that the processing is performed in units of jobs.

In the interleaf inserting apparatus 40, when a jam is detected during the primary sheet-feeding conveyance of the front cover sheet of the job 2, the primary sheet-feeding conveyance of the front cover sheet of the job 2 is stopped and the jam detection information is stored. At the point when the jam is detected, the sheets until the first image forming sheet of the job 2 (Q2-1) have been inserted in the image forming apparatus 20 and the sheet feeding apparatus 10. The following image forming sheet (Q2-2) is not newly fed, and the sheet-feeding thereof is stopped. At the merging point X of the post-processing apparatus 30, the image forming sheet of the job 1 (Q1-1) is conveyed following the front cover sheet of the job 1, and the discharge in the job 1 is completed. At the timing when the front cover sheet of the job 2 is inserted, the control is changed to the abnormal-sheet conveying control, the fed image forming sheet (Q2-1) is discharged to the sheet discharging tray T32 different from the sheet discharging tray T33 specified in the jobs 1 and 2. The recovery is performed from the top sheet of the job 2 (P2-front).

Note that, in the operation example 5, the conveying control when the processing is performed in units of sheets is the same as that of FIG. 15.

Operation Example 6

Figure 16:
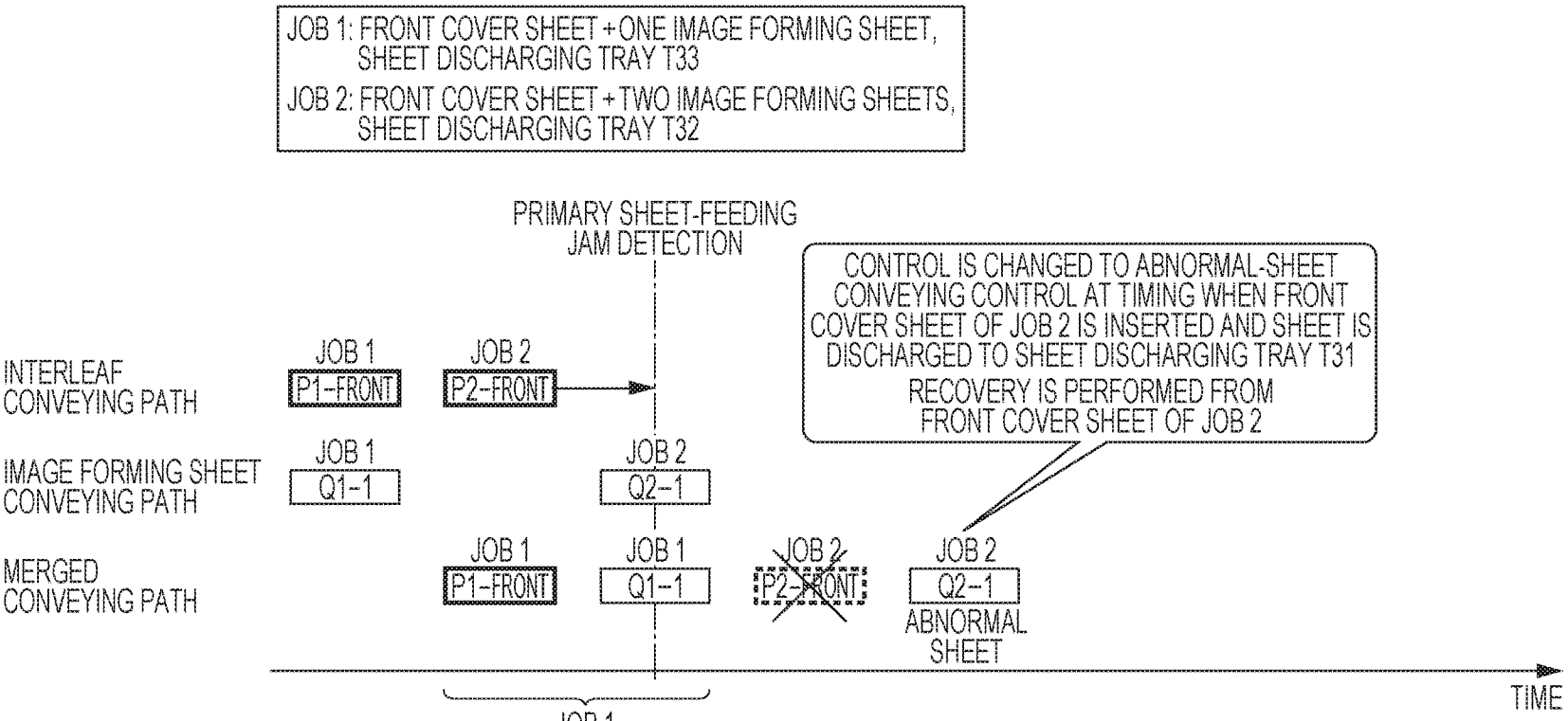
FIG. 16 is a diagram illustrating an example of sheet conveying control in an operation example 6.
Figure 17:
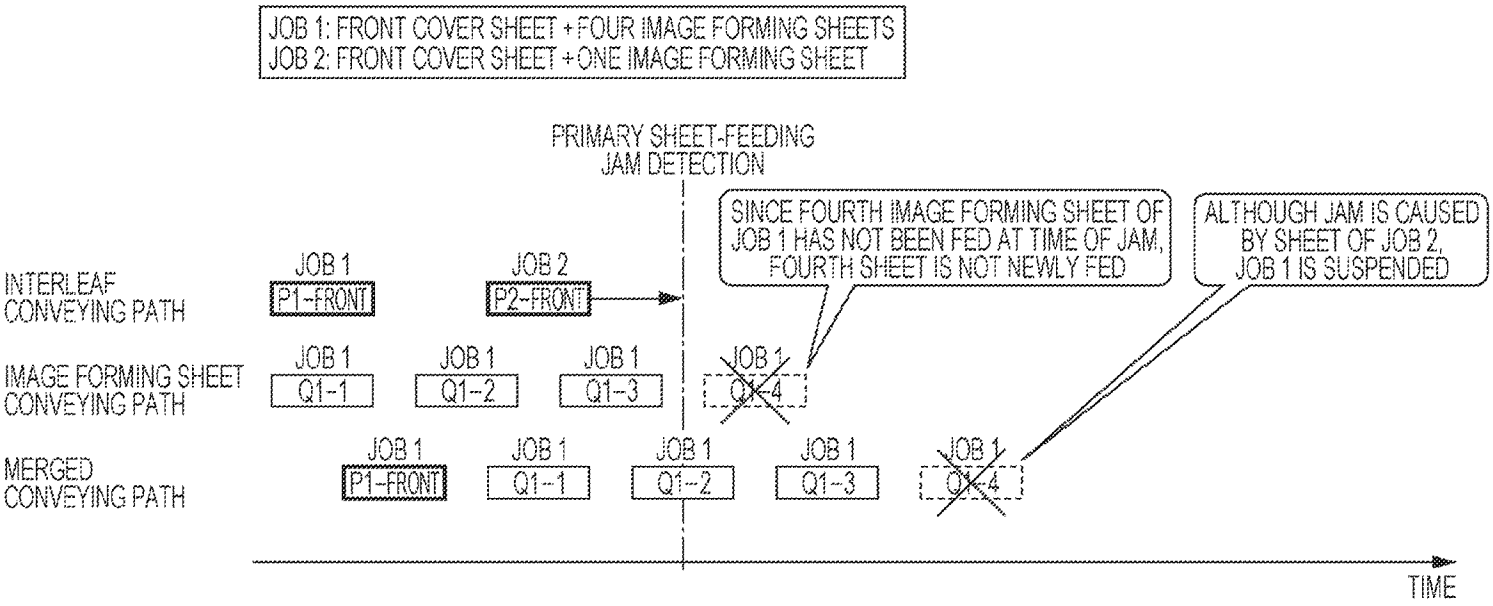
FIG. 17 PRIOR ART
FIG. 17 is a diagram illustrating an example of conventional sheet conveying control.

FIG. 16 illustrates an example of sheet conveying control of the interleaf conveying path in the interleaf inserting apparatus 40, the image forming sheet conveying path in the image forming apparatus 20 and the sheet feeding apparatus 10, and the merged conveying path after the merging point X of the post-processing apparatus 30 in an operation example 6. In the operation example 6, it is instructed to discharge an image forming sheet after a front cover sheet (interleaf) is discharged in the job 1, and to discharge two image forming sheets after a front cover sheet (interleaf) is discharged in the job 2. Furthermore, it is instructed to discharge output objects to the sheet discharging tray T33 of the post-processing unit 30D in the job 1 and to discharge output objects to the sheet discharging tray T32 of the post-processing unit 30C in the job 2. Moreover, in the operation example 6, it is selected that the processing is performed in units of jobs.

In the interleaf inserting apparatus 40, when a jam is detected during the primary sheet-feeding conveyance of the front cover sheet of the job 2, the primary sheet-feeding conveyance of the front cover sheet of the job 2 is stopped and the jam detection information is stored. At the point when the jam is detected, the sheets until the first image forming sheet of the job 2 (Q2-1) have been inserted in the image forming apparatus 20 and the sheet feeding apparatus 10. The following image forming sheet (Q2-2) is not newly fed, and the sheet-feeding thereof is stopped. At the merging point X of the post-processing apparatus 30, the image forming sheet of the job 1 (Q1-1) is conveyed following the front cover sheet of the job 1, and the discharge in the job 1 is completed. At the timing when the front cover sheet of the job 2 is inserted, the control is changed to the abnormal-sheet conveying control, the fed image forming sheet (Q2-1) is discharged to the sheet discharging tray T31 different from the sheet discharging tray T32 specified in the job 1 and the sheet discharging tray T33 specified in the job 2. The recovery is performed from the top sheet of the job 2 (P2-front).

Note that, in the operation example 6, the conveying control when the processing is performed in units of sheets is the same as that of FIG. 16. Furthermore, in the image forming system 100, when there is no sheet discharging tray different from the sheet discharging trays specified in the jobs 1 and 2, the conveyance of the fed image forming sheet (Q2-1) is stopped while being remained in the apparatus.

As described above, according to the image forming system 100 in the present embodiment, when sheets fed from the interleaf inserting apparatus 40 and the sheet feeding trays T11 to T15 are to be discharged to a downstream side through the merging point X and a jam occurs in the interleaf inserting apparatus 40, the image forming sheets which are not fed and are before the order, in which the interleaf causing the jam is supposed to be inserted, are newly fed and conveyed, and it is improve the productivity and work efficiency at the time of the recovery.

The interleaf-feeding in the interleaf inserting apparatus 40 is divided into the primary sheet-feeding conveyance and the secondary sheet-feeding conveyance, the primary sheet-feeding conveyance is performed before the timing when the interleaf is inserted. Thus, by continuing the sheet-feeding and conveyance of the image forming sheets before the interleaf causing the jam in the order when a jam is detected in the primary sheet-feeding conveyance unit 43, it is possible to improve the productivity and work efficiency at the time of the recovery.

When a mode for performing the processing in units of sheets is selected, the sheets until the image forming sheet right before the predetermined order, in which the interleaf causing the jam is supposed to be inserted, are newly fed. Thus, the conveyance of the image forming sheets can be continued as much as possible, and it is possible to perform the recovery operation from the interleaf causing the jam.

When a mode for performing the processing in units of jobs or sets is selected, the sheets until the sheet right before the top sheet of the job or the set including the sheet causing the jam, and the conveyance of the sheets can be terminated without crossing jobs or sets. Thus, it is possible to perform the recovery operation from the top sheet of the job or set including the sheet causing the jam. By performing the processing in units of jobs or sets, it is possible to meet outputting conditions in a job or a set when image stabilization control, such as density adjustment, or a sample (confirmation chart) output is performed at the time of the recovery after the jam occurrence.

Furthermore, when a sheet after the predetermined order, in which the sheet causing a jam is supposed to be inserted, has been fed at the point when the jam is detected, the fed sheets after the predetermined order is stopped or discharged to a discharge destination different from the discharge destination of the sheets before the predetermined order. Thus, it is possible not to mix normal output objects and the abnormal sheet.

Note that, the descriptions in the above embodiment are examples of the image forming system according to the present invention, and the present invention is not limited to these. The detail configurations and detail operations of the units composing the system can be changed without departing from the scope of the present invention.

For example, in the above embodiment, the example in which the first sheet feeding unit is the interleaf inserting apparatus 40 which feeds interleaves, and the second sheet feeding unit is the sheet feeding trays T11 to T15 which feeds sheets to form an image has been described, but both of the first sheet feeding unit and the second sheet feeding unit may feed sheets to form an image. Furthermore, the present invention may be applied to an image forming system which conveys sheets fed from three or more sheet feeding units.

In the above embodiment, the example in which the jam detecting unit 47 detects a jam in the primary sheet-feeding conveyance unit 43 has been described, but the jam detecting unit 47 may detect a jam in the secondary sheet-feeding conveyance unit 44. However, at the stage to perform the secondary sheet-feeding conveyance, the sheets until the sheet right before the interleaf, to which the secondary sheet-feeding conveyance is to be performed, have passed the merging point X, and the present invention is effective especially when a jam occurs in the primary sheet-feeding conveyance unit 43.

In the above embodiment, the image forming system 100 includes the image forming apparatus 20, the post-processing apparatus 30, and the interleaf inserting apparatus 40, but the image forming apparatus 20 may include the interleaf inserting apparatus 40 and the conveying path including the merging point X. Furthermore, the post-processing apparatus 30 may include the interleaf inserting apparatus 40. Moreover, the processing performed by the image-forming-apparatus control unit 21, the post-processing-apparatus control unit 31, and the interleaf-inserting-apparatus control unit 41 may be integrally performed by one control unit or may be dividedly performed by multiple control units.

In the above description, a ROM has been exemplified as a computer readable medium storing a program to perform the processing, but the present invention is not limited to this example. A non-volatile memory, such as a flash memory, or a portable recording medium, such as a CD-ROM, may be applied as other computer readable media. Furthermore, a carrier wave may be applied as a medium which provides program data through a communication line.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet conveyance apparatus which conveys sheets fed from a first sheet feeding unit and sheets fed from a second sheet feeding unit to a merging point, inserts the sheets fed from the first sheet feeding unit into the sheets fed from the second sheet feeding unit in a predetermined order at the merging point, and discharges the sheets fed from the first sheet feeding unit and the sheets fed from the second sheet feeding unit to a downstream side through the merging point, the sheet conveyance apparatus comprising:

a jam detecting unit configured to detect a jam of a sheet in the first sheet feeding unit; and a control unit configured to (i) newly feed, when the jam is detected by the jam detecting unit, sheets which precede a position in the predetermined order at which the sheet causing the jam is supposed to be inserted, which sheets have not yet been fed from the second sheet feeding unit, and (ii) convey the newly fed sheets to the downstream side through the merging point.

2. The sheet conveyance apparatus according to claim 1, wherein:

the first sheet feeding unit comprises a primary sheet-feeding conveyance unit configured to separate sheets one by one and convey the sheets to a resist part, and a secondary sheet-feeding conveyance unit configured to convey the sheets from the resist part to the merging point, and the jam detecting unit detects a jam of a sheet in the primary sheet-feeding conveyance unit.

3. The sheet conveyance apparatus according to claim 1, wherein the sheets to be newly fed from the second sheet feeding unit are image forming sheets until a sheet right before the position in the predetermined order at which the sheet causing the jam is supposed to be inserted.

4. The sheet conveyance apparatus according to claim 1, wherein the sheets to be newly fed from the second sheet feeding unit are image forming sheets until a sheet right before a top sheet in a job or a set including the sheet causing the jam.

5. An image forming apparatus comprising:

the sheet conveyance apparatus according to claim 1; and an image forming unit, wherein the first sheet feeding unit is an interleaf inserting apparatus which inserts an interleaf into sheets on which an image has been formed by the image forming unit.

6. The image forming apparatus according to claim 5, wherein the first sheet feeding unit is positioned downstream of the image forming unit, and the second sheet feeding unit is positioned upstream of the image forming unit.

7. The image forming apparatus according to claim 5, wherein at a point when the jam is detected by the jam detecting unit, when sheets after the position in the predetermined order at which the sheet causing the jam is supposed to be inserted have been fed from the second sheet feeding unit, the control unit stops or discharges the fed sheets after the position in the predetermined order to a discharge destination different from a discharge destination of sheets before the position in the predetermined order.

8. The sheet conveyance apparatus according to claim 1, wherein the second sheet feeding unit comprises a sheet tray that accommodates a plurality of sheets.

9. An image forming system which conveys sheets fed from an interleaf inserting apparatus and sheets fed from an image forming apparatus to a merging point, inserts the sheets fed from the interleaf inserting apparatus into the sheets on which an image has been formed by the image forming apparatus in a predetermined order at the merging point, and discharges the sheets fed from the interleaf inserting apparatus and the sheets fed from the image forming apparatus to a downstream side through the merging point, the image forming system comprising:

a jam detecting unit configured to detect a jam of a sheet in the interleaf inserting apparatus; and a control unit configured to (i) newly feed, when the jam is detected by the jam detecting unit, sheets which precede a position in the predetermined order at which the sheet causing the jam is supposed to be inserted, which sheets have not yet been fed from the image forming apparatus, and (ii) convey the newly fed sheets to the downstream side through the merging point.

10. A non-transitory recording medium storing a computer readable control program to control a sheet conveyance apparatus, the program causing a computer to execute:

conveying sheets fed from a first sheet feeding unit and sheets fed from a second sheet feeding unit to a merging point;

inserting the sheets fed from the first sheet feeding unit into the sheets fed from the second sheet feeding unit in a predetermined order at the merging point;

discharging the sheets fed from the first sheet feeding unit and the sheets fed from the second sheet feeding unit to a downstream side through the merging point;

detecting a jam of a sheet in the first sheet feeding unit;

newly feeding, when the jam is detected, sheets which precede a position in the predetermined order at which the sheet causing the jam is supposed to be inserted, which sheets have not been fed from the second sheet feeding unit; and conveying the newly fed sheets to the downstream side through the merging point.

11. The non-transitory recording medium storing the program according to claim 10, wherein the sheets to be newly fed from the second sheet feeding unit are image forming sheets until a sheet right before the position in the predetermined order at which the sheet causing the jam is supposed to be inserted.

12. The non-transitory recording medium storing the program according to claim 10, wherein the sheets to be newly fed from the second sheet feeding unit are image forming sheets until a sheet right before a top sheet in a job or a set including the sheet causing the jam.

* * * * *